US010182601B2

(12) United States Patent
Peshek et al.

(10) Patent No.: US 10,182,601 B2
(45) Date of Patent: Jan. 22, 2019

(54) BODY-ENHANCING GARMENT AND GARMENT CONSTRUCTION

(71) Applicant: VF Corporation, Greensboro, NC (US)

(72) Inventors: Darren J. Peshek, Irvine, CA (US); Justin T. Mark, Irvine, CA (US); Brian Marion, Irvine, CA (US); Kyle Stephens, Irvine, CA (US); Donald Hoffman, Irvine, CA (US); Stephen H. Zades, Greensboro, NC (US)

(73) Assignee: VF CORPORATION, Greensboro, NC (US)

( * ) Notice: Subject to any disclaimer, the term of this patent is extended or adjusted under 35 U.S.C. 154(b) by 23 days.

(21) Appl. No.: 15/212,637

(22) Filed: Jul. 18, 2016

(65) Prior Publication Data

US 2018/0014590 A1 Jan. 18, 2018

(51) Int. Cl.

| | |
|---|---|
| ***A41D 1/06*** | (2006.01) |
| ***A41D 27/20*** | (2006.01) |
| ***A41D 27/24*** | (2006.01) |
| ***A41B 1/08*** | (2006.01) |
| ***A41D 1/14*** | (2006.01) |
| ***A41D 1/22*** | (2018.01) |
| ***A41D 3/00*** | (2006.01) |
| ***A41D 7/00*** | (2006.01) |

(52) U.S. Cl.

CPC ..... *A41D 1/06* (2013.01); *A41B 1/08* (2013.01); *A41D 1/14* (2013.01); *A41D 1/22* (2013.01); *A41D 3/00* (2013.01); *A41D 7/00* (2013.01); *A41D 27/20* (2013.01); *A41D 27/24* (2013.01); *A41D 2400/38* (2013.01)

(58) Field of Classification Search

CPC ..... A41D 27/20; A41D 2400/38; A41D 1/06; A41B 1/08

USPC ..... 32/228

See application file for complete search history.

(56) References Cited

U.S. PATENT DOCUMENTS

| | | | | |
|---|---|---|---|---|
| 1,654,064 A | | 12/1927 | Zaki | |
| 1,697,255 A | | 1/1929 | Wolff | |
| 1,817,053 A | | 8/1931 | Zerk | |
| 1,852,138 A | | 4/1932 | Zerk | |
| 2,381,580 A | * | 8/1945 | Einbinder | A41D 27/20 2/247 |

(Continued)

FOREIGN PATENT DOCUMENTS

| | | |
|---|---|---|
| CN | 3546110 | 7/2006 |
| CN | 301869010 | 3/2010 |

(Continued)

OTHER PUBLICATIONS lee jeans _ The Geek Lounge, Jun. 4, 2014. https://geeklounge.wordpress.com/tag/lee-jeans/.*

(Continued)

*Primary Examiner* — Shaun R Hurley
*Assistant Examiner* — Bao-Thieu L Nguyen
(74) *Attorney, Agent, or Firm* — Baker & Hostetler LLP

(57) ABSTRACT

Systems or methods for anatomy warping a garment are provided. Anatomy warping is any deliberate manipulation of a garment's seams, pockets, and/or other construction lines and/or details in order to change the perceived shape of a wearer of the garment toward a desired appearance. Additionally, the garments that result from use of these systems and methods for anatomy warping are also provided.

19 Claims, 22 Drawing Sheets

(56) References Cited

U.S. PATENT DOCUMENTS

| | | | | |
|---|---|---|---|---|
| 2,718,640 | A * | 9/1955 | Suckle | A41D 27/20 2/243.1 |
| 2,840,824 | A * | 7/1958 | Horner | A41D 27/20 2/247 |
| 3,683,419 | A | 8/1972 | Lewis | |
| 3,691,971 | A | 9/1972 | Clarke | |
| 3,696,845 | A | 10/1972 | Acker et al. | |
| D259,820 | S * | 7/1981 | Heinfling | D2/742 |
| 4,282,609 | A | 8/1981 | Freedman et al. | |
| 4,888,713 | A | 12/1989 | Falk | |
| 5,065,458 | A | 11/1991 | Johnson | |
| 5,535,451 | A * | 7/1996 | Tassone | A41D 1/06 2/227 |
| 5,990,444 | A | 11/1999 | Costin | |
| 6,175,966 | B1 * | 1/2001 | Wiesenthal | A41D 27/08 2/243.1 |
| 7,058,987 | B2 * | 6/2006 | Salazar | A41D 1/06 2/227 |
| 7,107,621 | B2 | 9/2006 | Meekins | |
| D558,954 | S * | 1/2008 | Lew | D2/857 |
| D586,084 | S * | 2/2009 | Mendoza | D2/742 |
| 7,814,576 | B2 * | 10/2010 | Nakazawa | A41D 13/0015 2/227 |
| D650,154 | S | 12/2011 | Saavedra | |
| 8,869,313 | B2 * | 10/2014 | Maramotti | A41D 1/06 2/247 |
| 8,959,665 | B1 * | 2/2015 | Garner | A41F 9/00 2/236 |
| 8,984,668 | B2 * | 3/2015 | Tulin | A41D 1/06 2/227 |
| 9,326,552 | B2 * | 5/2016 | Hays | A41B 9/08 |
| D768,359 | S * | 10/2016 | Lago; Silvana | D2/742 |
| 9,468,239 | B2 * | 10/2016 | Battah | A41D 1/06 |
| D793,033 | S * | 8/2017 | Neary | D2/742 |
| 9,801,420 | B2 * | 10/2017 | Hays | A41D 1/06 |
| D802,256 | S * | 11/2017 | Peshek | D2/742 |
| 2004/0205879 | A1 * | 10/2004 | Leba | A41D 27/20 2/247 |
| 2006/0235656 | A1 | 10/2006 | Mochimaru et al. | |
| 2007/0266478 | A1 * | 11/2007 | Girod | A41D 1/00 2/227 |
| 2008/0271226 | A1 * | 11/2008 | Erana Ahumada | A41B 9/001 2/228 |
| 2009/0157021 | A1 | 6/2009 | Sullivan et al. | |
| 2010/0136882 | A1 * | 6/2010 | Malish | A41C 1/06 450/11 |
| 2011/0010818 | A1 * | 1/2011 | Hood | A41D 27/20 2/102 |
| 2011/0185477 | A1 * | 8/2011 | Olenicoff | A41D 27/20 2/247 |
| 2011/0214216 | A1 * | 9/2011 | Zarabi | A41D 27/02 2/69 |
| 2012/0023644 | A1 | 2/2012 | Maramotti | |
| 2014/0165265 | A1 * | 6/2014 | Tulin | A41D 1/06 2/234 |
| 2014/0182044 | A1 * | 7/2014 | Cole | A41D 27/20 2/69 |
| 2014/0273742 | A1 * | 9/2014 | Hays | A41D 1/06 450/95 |
| 2015/0082516 | A1 * | 3/2015 | Doan | A41D 27/205 2/220 |
| 2015/0106993 | A1 | 4/2015 | Hoffman et al. | |
| 2015/0196068 | A1 * | 7/2015 | Tulin | A41D 1/06 2/227 |
| 2015/0213646 | A1 | 7/2015 | Ma | |
| 2015/0339853 | A1 | 11/2015 | Wolper | |
| 2016/0189431 | A1 | 6/2016 | Ueda | |
| 2016/0227854 | A1 | 8/2016 | Ellis | |
| 2016/0324234 | A1 | 11/2016 | Hoffman et al. | |
| 2018/0014583 | A1 | 1/2018 | Peshek | |
| 2018/0020752 | A1 | 1/2018 | Peshek | |
| 2018/0110273 | A1 | 4/2018 | Peshek | |
| 2018/0168256 | A1 | 6/2018 | Peshek | |

FOREIGN PATENT DOCUMENTS

| | | |
|---|---|---|
| CN | 301600315 | 7/2011 |
| CN | 302245662 | 12/2012 |
| CN | 302245667 | 12/2012 |
| CN | 302554428 | 9/2013 |
| FR | 2876880 | 4/2006 |
| JP | 2004156153 | 6/2004 |
| WO | 2006032096 | 3/2006 |
| WO | 2007055072 | 5/2007 |
| WO | 2007112494 | 10/2007 |
| WO | 2012004365 | 1/2012 |
| WO | 20130154445 | 10/2013 |
| WO | 2018017732 | 1/2018 |

OTHER PUBLICATIONS

Men's Jeans and women's jeans and denim jacket measurements to check or make your own pattern, Oct. 11, 2007. https://web.archive.org/web/20071011004827/http://www.jeansinfo.org/measurements.html.*

Cuenca-Guerra, et al., "What makes Buttocks Beautiful" A Review and Classification of the Determinants of Gluteal Beauty and the Surgical Techniques to Achieve Them, Aesthetic Plastic Surgery, 2004 Springer Science+Business Media, Inc. 2004.

Hoffman, "Visual Intelligence: How We Create What We See", Published by W.W. Norton, 2000.

PCT International Search Report in PCT/US2014/061277, dated Jan. 27, 2015, 10 pages.

U.S. Appl. No. 14/517,339, Amendment and Response filed Dec. 5, 2017, 10 pages.

PCT International Search Report in PCT/US2017/042885, dated Sep. 11, 2017, 14 pages.

PCT International Search Report in PCT/US2017/042888, dated Sep. 11, 2017, 15 pages.

PCT Invitiation to Pay Additional Fees in PCT/US2017/0422000, dated Sep. 20, 2017, 15 pages.

"Truly Wow Slim Leg Jeans Long Simply Be", Aug. 1, 2012, 3 pages, http://www.simplybe.co/uk/shop/truly-wow-slimleg-jeans-long.co.uk/shop/truly-wow-slim-leg-jeans-long/qy094/product/details/show.action?pdBoUid=5205#colour;size.

Anonymous, "Kilowog muscle suit", Aug. 3, 2010, XP055371226, http://theleagueofheroes.yuku.com. Retreived from the Internet: http://theleagueofheroes.yuku.com/topic9266/Kilowog-muscle-suit#.WRL4-HpMek5, 7 pages.

European Extended Search Report in Application 14854060.2, dated May 18, 2017, 9 pages.

PCT International Search Report in PCT/US2017/042200, dated Nov. 28, 2017, 22 pages.

Spoon Graphics, "8 Free Stipple Shading Brushes for Abode Illustrator" May 25, 2015, https://blog.spoongraphics.co.uk/freebies/8-free-stripple-shading-brushes-for-adobe-illustrator.

PCT International Search Report in PCT/US2018/017967, dated Apr. 26, 2018, 14 pages.

* cited by examiner

BODY-ENHANCING GARMENT AND GARMENT CONSTRUCTION

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

INTRODUCTION

It is common for clothing manufactures to construct garments with visible seams, pockets, and other lines and/or details. These construction features can be necessary for the garment's shape, the garment's fit, or superfluous details added to make a fashion statement. These construction features will form lines that fall on the wearer's body.

It is with respect to these and other general considerations that aspects disclosed herein have been made. Also, although relatively specific problems may be discussed, it should be understood that the aspects should not be limited to solving the specific problems identified in the background or elsewhere in this disclosure.

SUMMARY

This disclosure generally relates to systems and methods for anatomy warping. More specifically, anatomy warping is any deliberate manipulation of a garment's seams, pockets, and/or other construction lines and/or details in order to change the perceived shape of a wearer of the garment toward a desired appearance. Additionally, the disclosure generally relates to the garments that result from use of these systems and methods for anatomy warping.

In one aspect, the disclosure is directed to a body-enhancing garment. The garment includes a front side, a rear side, a first pocket and a second pocket. The rear side is opposite the front side. The first pocket on the rear side is positioned at least partially over a first cheek of a buttocks of a wearer of the garment when worn. The second pocket on the rear side is positioned at least partially over a second cheek of the buttocks of the wearer of the garment when worn. The first pocket and the second pocket each include:

- an interior edge with a first curve above a second curve; and/or
- a curved top edge that arches away from the center of the pocket.

The first curve arches toward a center of the pocket and the second curve arches away from the center of the pocket. The lines and details formed by the first pocket and the second pocket change an appearance of the buttocks of the wearer when worn.

In another aspect, the disclosure is directed to a body-enhancing garment. The garment includes a front side, a first side seam, a second side seam, a rear side, and a yoke. The second side seam is opposite the first side seam. The rear side is opposite the front side. The yoke is positioned on the rear side. The yoke is anatomy warped and positioned below a waistline of the garment. Further, the yoke has a right curve and a left curve. The right curve extends from the first side seam to a center of the rear side and arches toward a top of the garment. The left curve extends from the second side seam to the center of the rear side and arches toward the top of the garment. The right curve and the left curve connect at the center of the rear of the garment.

In an additional aspect, the disclosure provides a body-enhancing pair of pants. The pants include a first side panel and a second side panel. The first side panel is formed between a first seam and a second seam. The second side panel is formed between a third seam and fourth seam. The width of the first side panel and the second side panel gradually decreases from a top to a bottom of the pants. The first side panel and the second side panel may make the legs of a wearer of the pants appear longer and/or thinner.

In yet another aspect, a method for designing a body-enhancing garment is disclosed. The method includes:

- selecting a feature for anatomy warping;
- determining a desired appearance for the selected feature;
- determining one or more construction lines and/or details for changing a perception of the selected feature toward the desired appearance based on the rules of perception; and
- adding the one or more determined construction lines and/or construction details to the garment.

The determining the one or more construction lines and/or details includes determining positioning of the lines and/or details on the garment and sizing of the lines and/or details on the garment.

In yet additional aspects, the disclosure includes a method for designing or constructing a body-enhancing garment. The method includes:

- identifying a desired 3-D body shape;
- converting the 3-D body shape into a 2-D depth map;
- identifying construction details and/or lines for a flat garment;
- positioning the construction details and/or lines on the 2-D depth map of the garment;
- adjusting the construction details and/or lines utilizing the position on the 2-D depth map to create warped construction details and/or lines; and
- creating a 2-D image of the warped construction details and/or lines using perspective projection; and
- constructing a garment with the warped construction details and/or lines based on the 2-D image of the warped construction details and/or lines.

In further aspects, the disclosure provides a method for designing or constructing a body-enhanced garment. The method includes:

- applying a flat grid to or bending the flat grid around an actual 3-D body shape and around a desired 3-D body shape of a selected body feature to form two different bent grids;
- positioning selected construction lines and/or details over each of the grids of the body shape;
- finding curve differences between the curves of the two different bent grids at corresponding locations of the positioned construction details and/or lines on each of the grids; and
- utilizing these determined curve differences to warp the construction lines and details at the corresponding grid locations.

This summary is provided to introduce a selection of concepts in a simplified form that are further described below in the Detailed Description. This summary is not intended to identify key features or essential features of the claimed subject matter, nor is it intended as an aid in determining the scope of the claimed subject matter.

These and other features and advantages will be apparent from a reading of the following detailed description and a review of the associated drawings. It is to be understood that both the foregoing general description and the following detailed description are illustrative only and are not restrictive of the claims.

DETAILED DESCRIPTION

In the following detailed description, references are made to the accompanying drawings that form a part hereof, and in which are shown by way of illustrations specific embodiments or examples. These embodiments or examples may be combined, other embodiments or examples may be utilized, and structural changes may be made without departing from the spirit or scope of the present disclosure. The following detailed description is therefore not to be taken in a limiting sense, and the scope of the present disclosure is defined by the appended claims and their equivalents.

Figure 1:
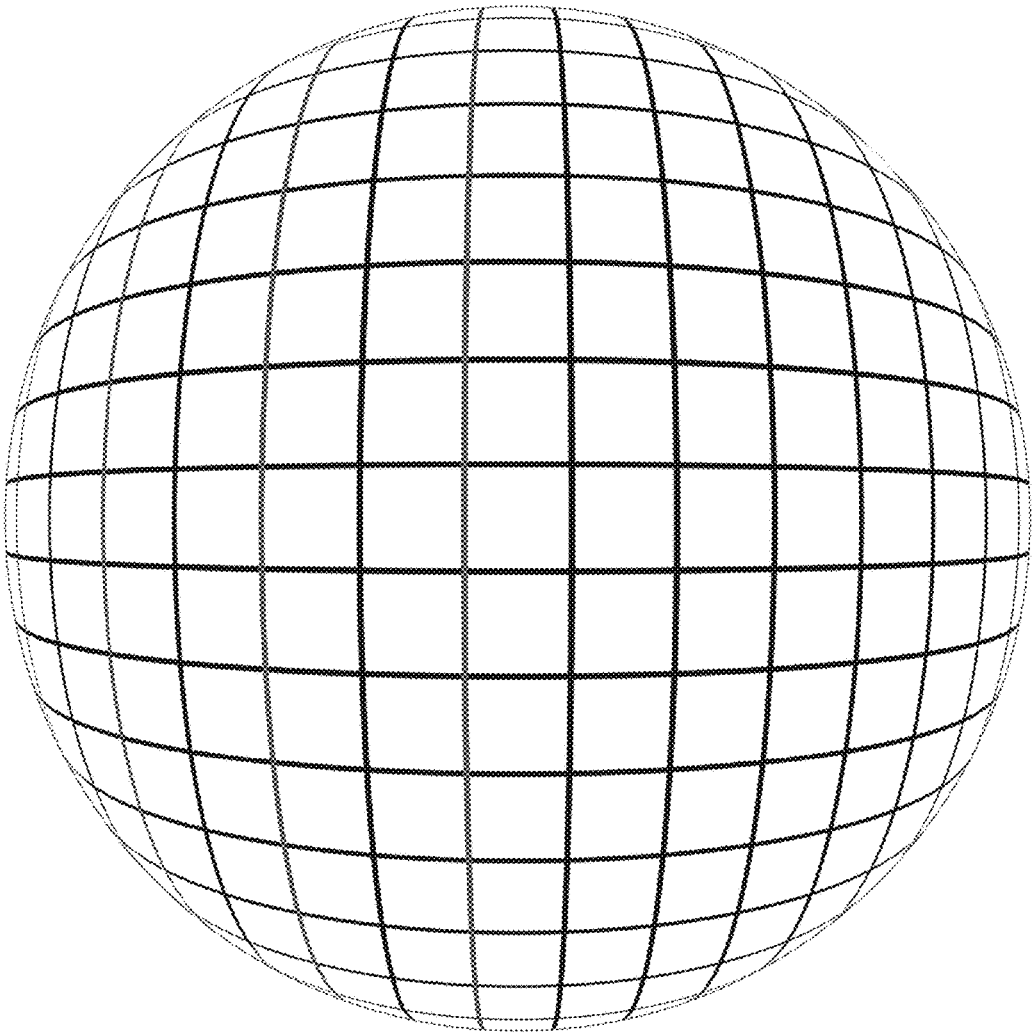
FIG. 1 is a two-dimensional picture illustrating a rule of perception (geodesic assumption) utilized by the brain, in accordance with an aspect of the disclosure.

Each time humans open their eyes, their brains performs trillions of computations in order to see a three-dimensional (3-D) world. These computations operate according to a set of rules. One of these rules is the geodesic assumption: Curved lines on a surface reveal 3-D shape of that surface. This is why, a person looking at FIG. 1 cannot help but see a 3-D shape even though the lines are, of course, flat. Specifically, FIG. 1 is a two-dimensional image that consists of only curved lines. The visual system, utilizing the geodesic assumption, assumes that lines on a surface curve due to the 3-D shape of the surface. Accordingly, the brain interprets the curved lines as laying on the surface of a sphere, which is viewed as coming out of the page.

Figure 2:
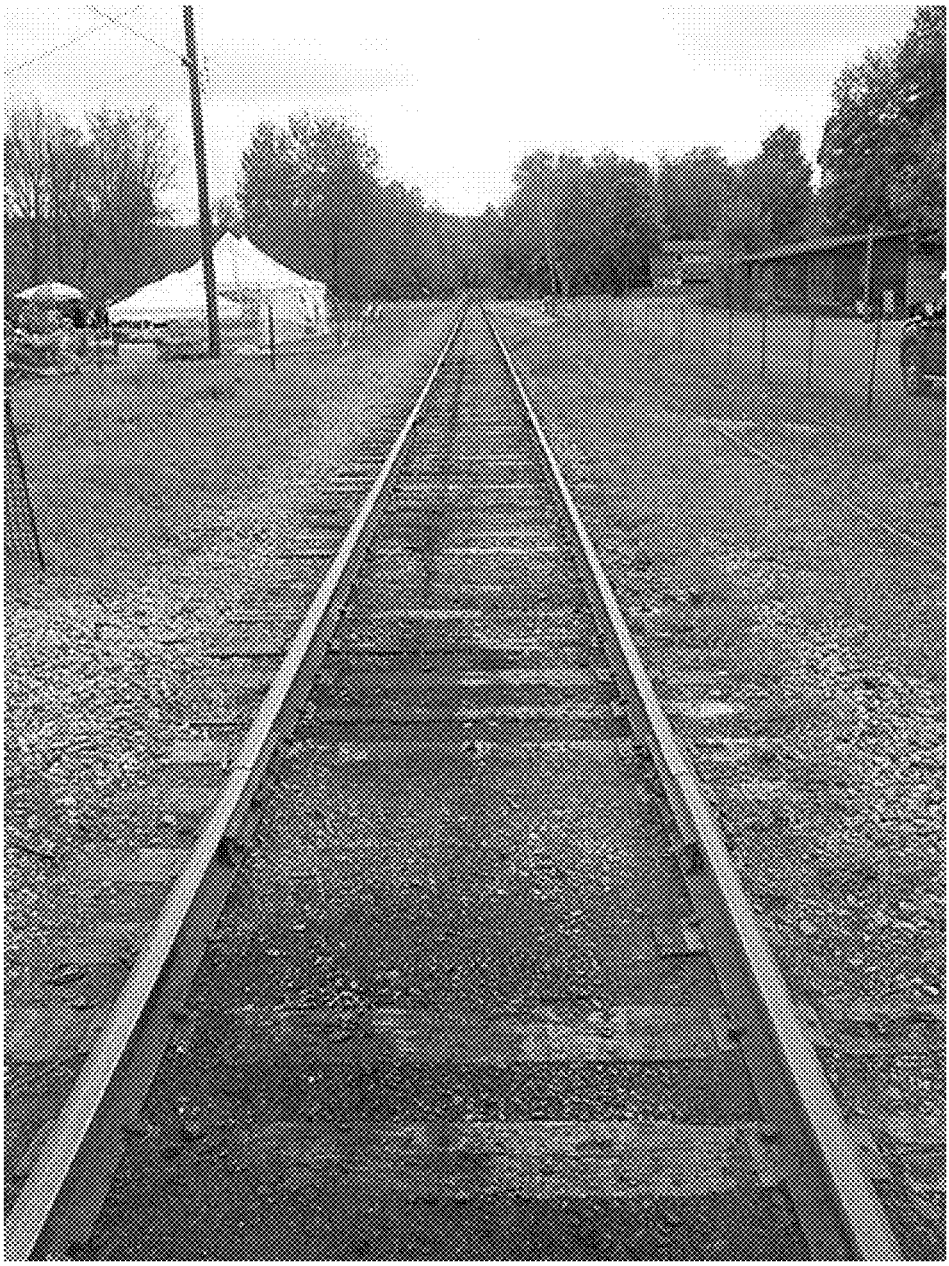
FIG. 2 is a two-dimensional picture illustrating a rule of perception (linear perspective) utilized by the brain, in accordance with an aspect of the disclosure.

Another rule utilized by the visual system is linear perspective. An example of linear perspective is shown in FIG. 2 where parallel train tracks converge as they recede into the distance. This depth cue utilizes the fact that as objects move further away their visual angle decreases. Therefore, if we take the distance between the train tracks as our object, then the bottom of the image, where the train tracks are very wide, appears close to the viewer, while the top of the image where the train tracks are very narrow, appears far from the viewer. The image presented in FIG. 2 is two-dimensional (2-D), so the perception of depth is entirely constructed by the visual system, primarily utilizing the linear perspective cue.

Many garments are constructed with visible seams, pockets, and other details that are in addition to the main fabric. These construction details often form straight lines when the garment is laid flat, but become curved when worn on the body (a property of geodesics; see FIG. 3). The visual system assumes that the curvature of those lines is attributed entirely to the body shape (i.e., that curved lines on the garment would be straight lines if the garment was laid flat). Thus, using the geodesic assumption, the visual system will construct a three-dimensional body shape based in part on the curvature of the construction details It is known from the field of evolutionary psychology that each time an individual encounters a person, the individual's brain automatically evaluates a multitude of sensory cues relating to the health and reproductive fitness of the person within a fraction of a second. The individual's initial judgment on attractiveness is a summary of that evaluation, with greater attractiveness being felt toward individuals who appear healthier and more reproductively fit. Therefore, the three-dimensional shape of a person's body is a critical sensory cue that is used to assess the attractiveness of the person.

When a person wears clothing, they voluntarily put several lines or construction details on their body. The brain interprets these details and lines using the rules discussed above and several others. Current clothing designs do not take into account that the brain adds its own interpretations to lines and details on garments to change the shape of the wearer. As such, a problem with existing garment construction or design is that it can create garments that make an individual's form less attractive to others, a result that is clearly not desired by the individual wearing the garment. While the rules of perception have been heavily studied, these rules have not been applied to clothing. Further, the rules of perception have not been utilized on a garment to change the perception of a human feature to fall within or move toward known attractive size and shape ranges and/or desired size and shape ranges when worn.

As such, there is typically no system or method that utilizes the rules of perception and desired feature ranges to design or manufacture clothing. Therefore, the systems and methods disclosed herein provide systems and/or methods for systematically constructing garments, using the rules of perception, to change the perceived shape of the wearer. These construction changes are based on the anatomy of any wearer and are referred to herein as anatomy warping. In some embodiments, anatomy warping is used to increase the attractiveness of the wearer. For instance, an attractive body will curve the seams and pockets on a garment differently than an unattractive body. Thus, the systems and methods as disclosed herein may curve the construction details on a flat garment based on the curves created by an attractive body to change the perception of the 3-D shape of the wearer in such a way that the wearer is perceived as more attractive. However, in other embodiments, anatomy warping is used to change the appearance of the wearer toward any desired feature shape.

The changes to construction features of the garment may cover any human body part or area, such as the buttocks, legs, chest, waist, feet, hips, etc. This list is exemplary only and is not meant to be limiting. Garments include any clothing item that can be worn by a human, such as pants, shirts, skirts, jackets, shorts, skirts, dresses, leggings, capris, bras, underwear, swim wear, shoes, and etc. This list is exemplary only and is not meant to be limiting.

Figure 3A:
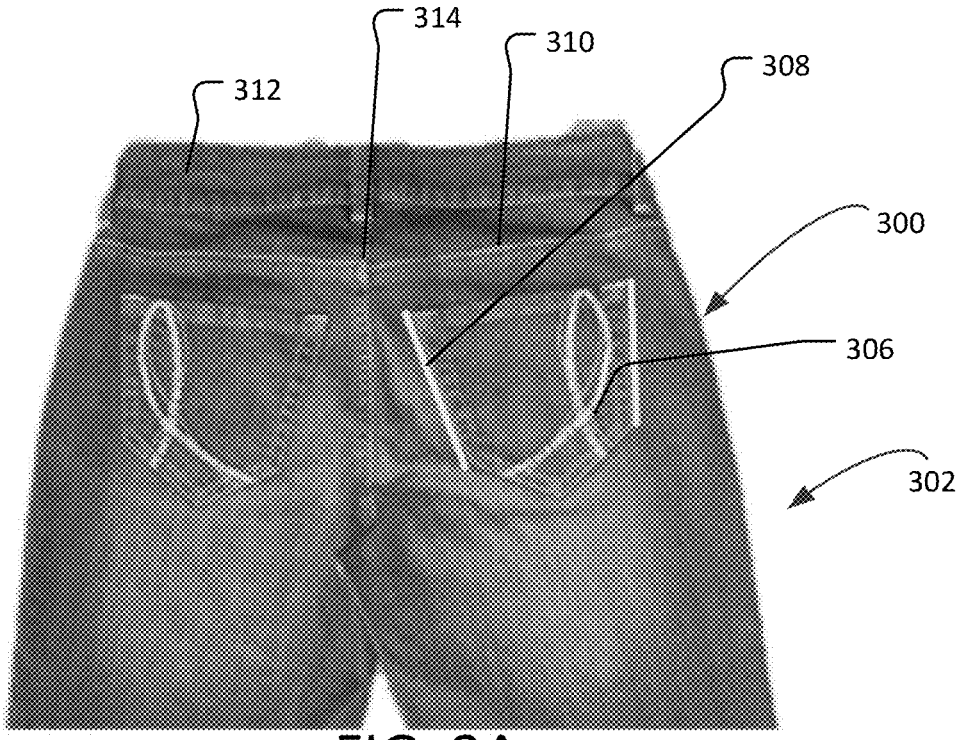
FIG. 3A is a partial rear view illustrating a pair of jeans lying flat, in accordance with an aspect of the disclosure.
Figure 3B:
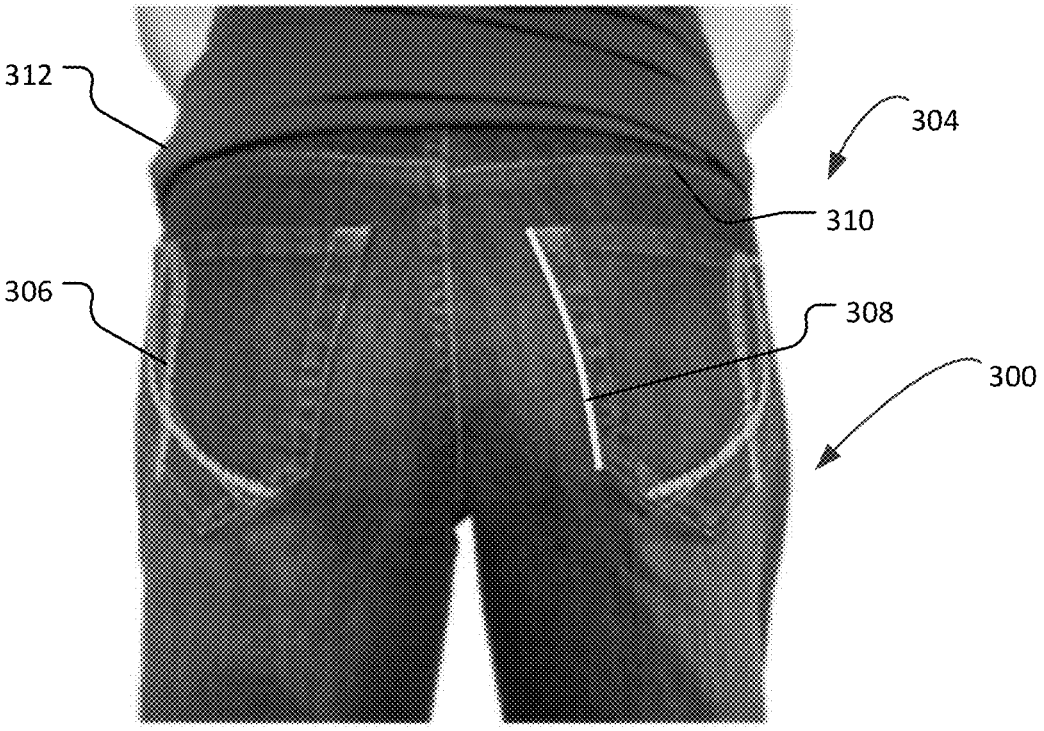
FIG. 3B is a partial rear view illustrating the pair of jeans from FIG. 3A on a wearer, in accordance with an aspect of the disclosure.

Referring now to the drawings, in which like numerals represent like elements through the several figures, various aspects of the present disclosure will be described. FIG. 3 is a partial rear view illustrating a pair of jeans 300 lying flat 302 and being worn 304, in accordance with an aspect of the disclosure. The pockets 306 have straight edges 308. When the jeans 300 are worn 304, the straight edges 308 appear to curve. As discussed above, straight lines appear curved when placed over a round object. The brain interprets this curve and estimates the size and shape of the buttocks based in part on this curve.

Knowing that the brain automatically constructs a 3-D shape from the curves on the buttocks, the shape, size, and/or positioning of the pockets can be adjusted to change the perceived shape of the buttocks. The field of plastic surgery has identified several properties of the shape of the female buttocks that are considered attractive. As such, the pockets can be adjusted to change the perceived shape of the buttocks to appear more attractive or to appear closer to these known plastic surgery properties. The field of plastic surgery has also identified properties of the shape of several other body parts, areas, and/or features that are considered attractive that may be utilized for anatomy warping.

Figure 4:
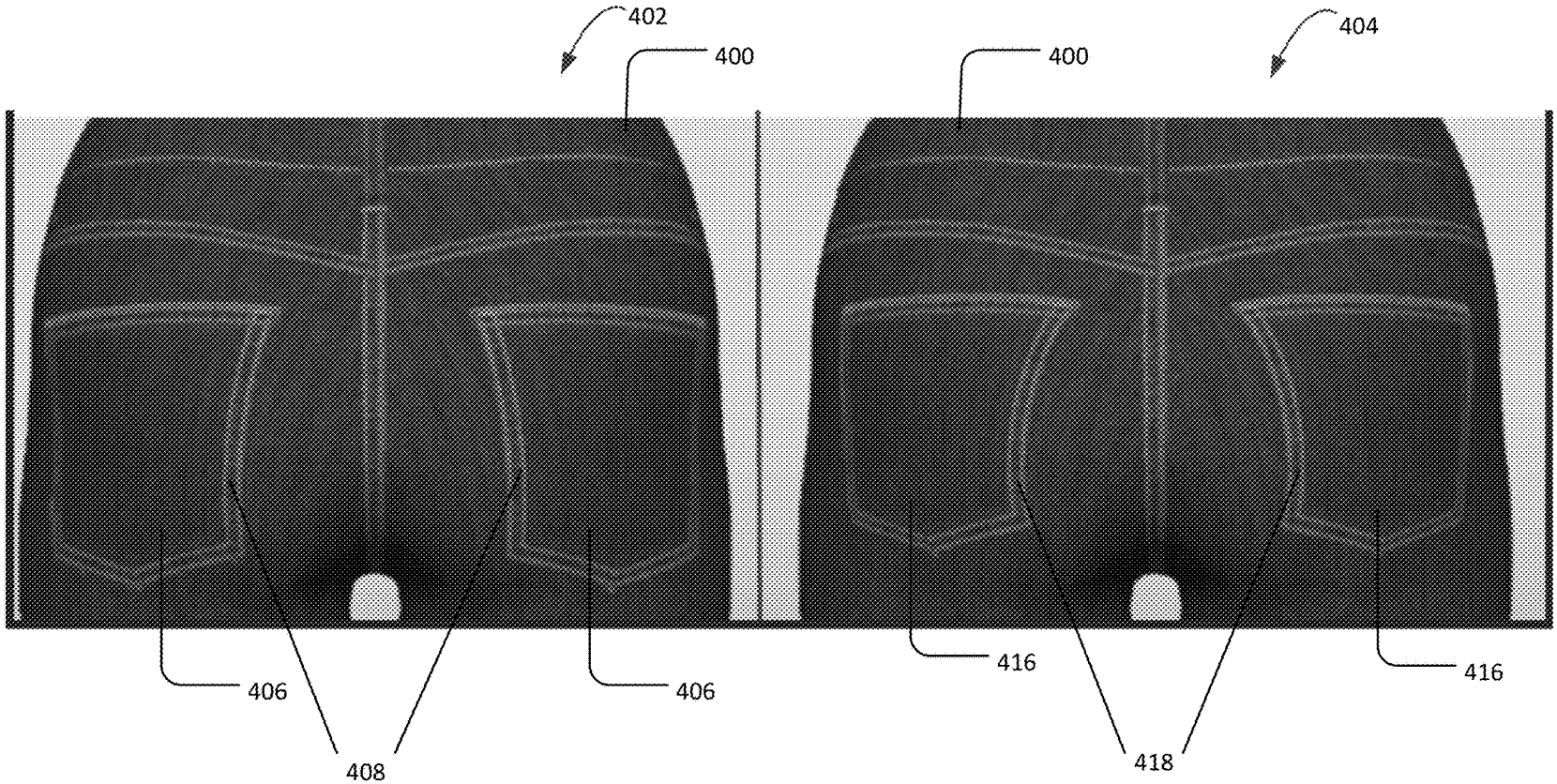
FIG. 4 is a partial rear view illustrating a pair of jeans with conventional pockets and the same pair of jeans with anatomy-warped pockets worn by the same virtual body, in accordance with an aspect of the disclosure.

For example, FIG. 4 is a partial rear view illustrating a pair of jeans 400 with conventional pockets 406 and the same pair of jeans 400 with anatomy-warped pockets 416 worn by the same virtual body or avatar, in accordance with an aspect of the disclosure. The jeans 400 with the conventional pockets 406 are referred to as standard jeans 402. The jeans 400 with the anatomy-warped pockets 416 are referred to as adjusted jeans 404. Each of the different jeans 400 includes a first pocket on the rear side positioned at least partially over a first cheek of the buttocks of a wearer when worn and a second pocket on the rear side positioned at least partially over a second cheek of the buttocks of the wearer when worn. A pocket as utilized herein refers to a receptacle or compartment on a garment or the outline of a faux receptacle or compartment. A faux receptacle or compartment as utilized herein is a compartment represented by seaming, but that is not actually present on the garment. Standard jeans 402 utilize a conventional pocket 406 with straight side edges 408 and standard pocket sizing and positioning. Adjusted jeans 404 include anatomy-warped pockets 416. The anatomy-warped pockets 416 are adjusted to change the perceived shape of the buttocks utilizing the rules of perception when compared to the standard jeans 402 utilizing the conventional pocket 406. For example, the interior side edge 418 of pocket 416 is curved. In this embodiment, the interior side edge 418 includes an arc or curve of 12 degrees. However, other curve angles may be utilized to achieve other desired feature shapes. Additionally, in this embodiment, the pockets 416 are 9% smaller, moved inward by 0.3 inches, and moved upwards by 0.25 inches when compared to the conventional pockets 406 on the standard jeans 402. These differences in constructions lines and details change the appearance of the wearer's buttocks to appear more attractive based on the known plastic surgery features when compared to conventional pocket 406.

Several different processes or methods may be utilized to anatomy-warp garments. In some embodiments, anatomy warping may be performed by manually adjusting construction lines and details on clothing base on the rules of perception (such as the principles of the geodesic assumption) after visible inspection on live models. In other embodiments, anatomy warping is based on a difference in curves found between an actual body shape of a selected feature and a desired body shape for that selected feature. In other embodiments, a method 1600 for anatomy warping may be utilized as illustrated in FIG. 16.

Figure 16:
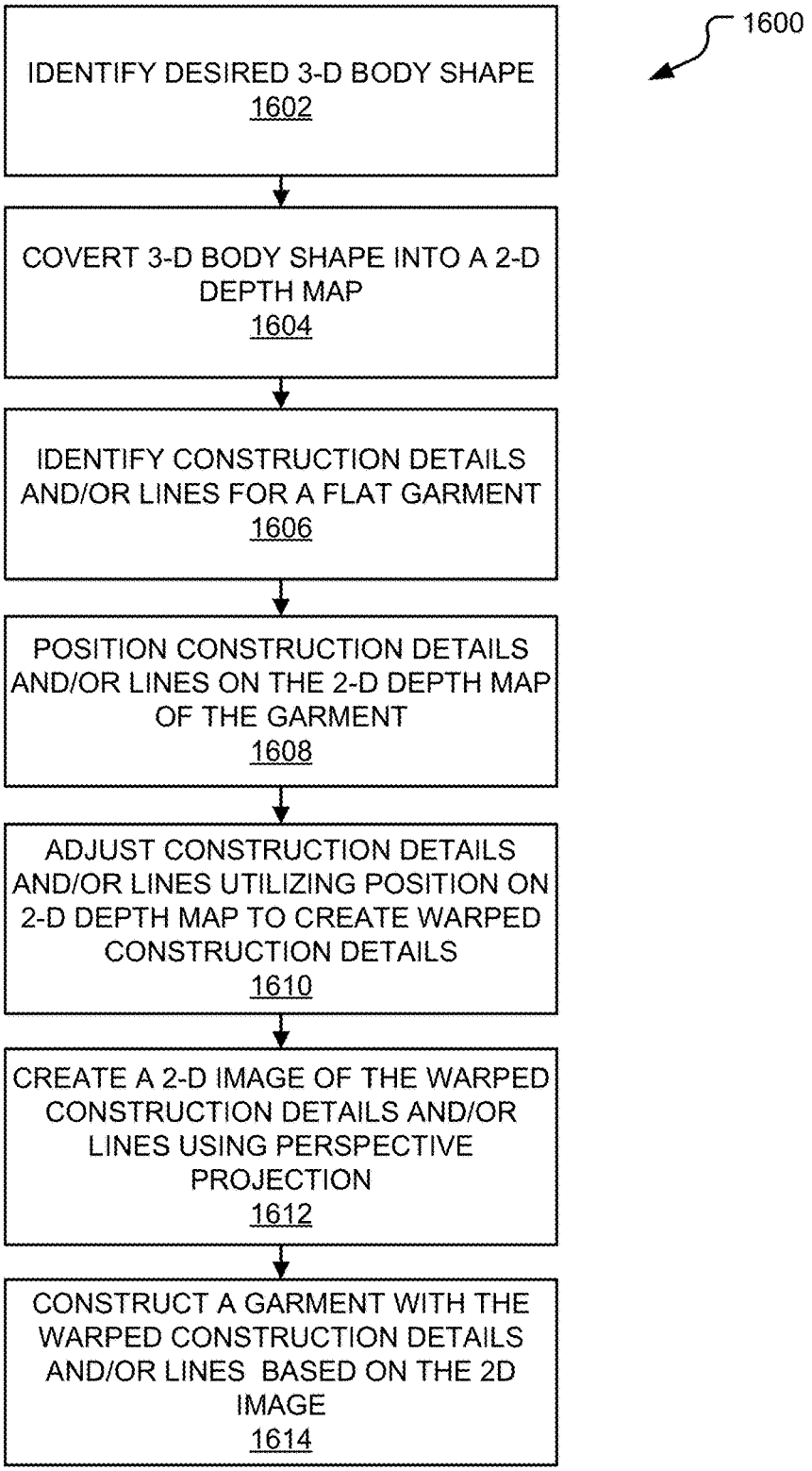
FIG. 16 is a flow diagram illustrating a method for designing or constructing an anatomy-warped garment, in accordance with an aspect of the disclosure.

FIG. 16 is a flow diagram illustrating a method 1600 for designing or constructing an anatomy-warped garment, in accordance with an aspect of the disclosure. Anatomy warping uses the rules of perception to change a perceived size and/or shape of the anatomy of the wearer. In some embodiments, anatomy warping is used to increase the attractiveness of the wearer. FIGS. 5A-5E illustrate schematic examples of different operations of method 1600 for anatomy warping a pair of jeans to change the appearance of a buttocks.

Figure 5A:
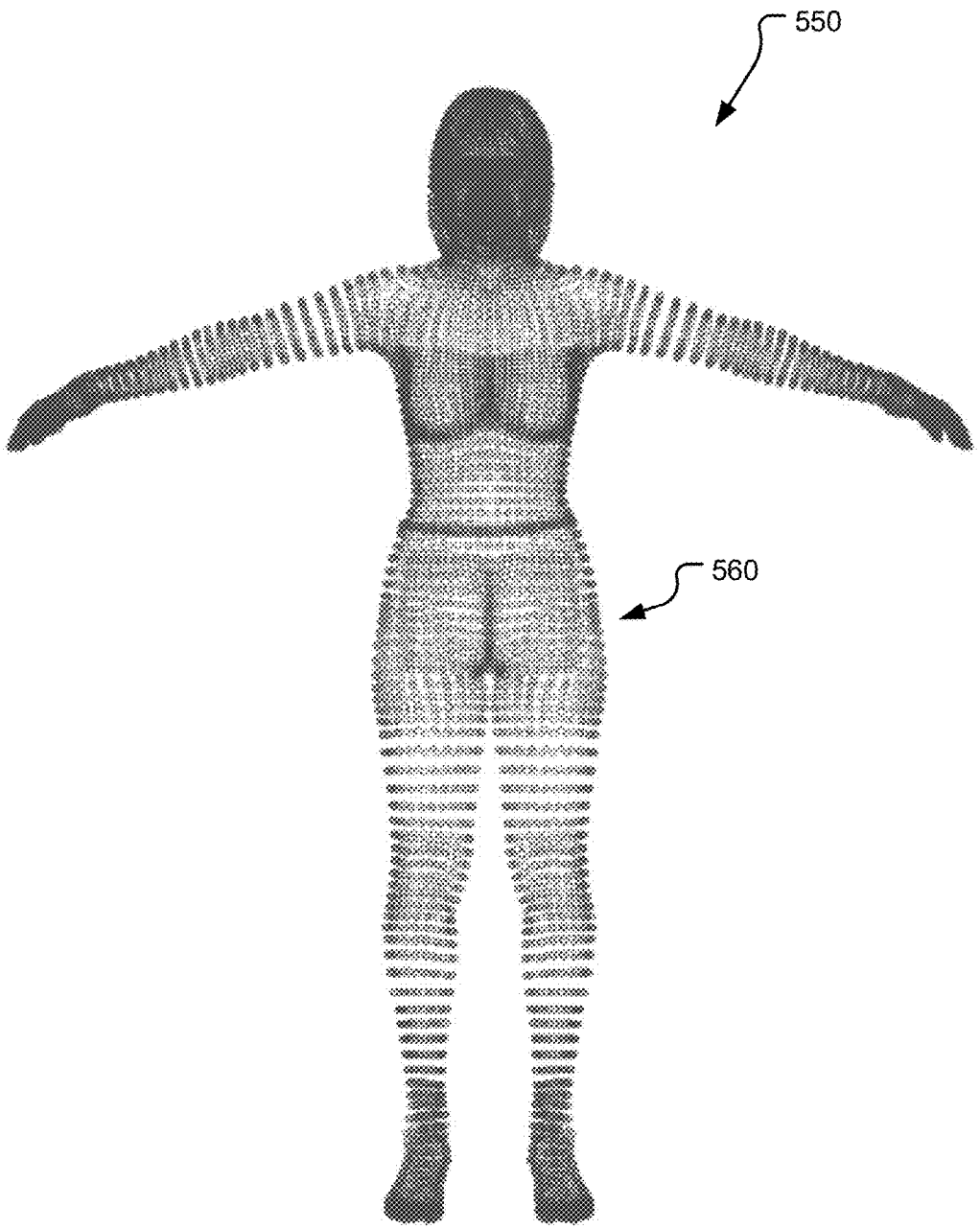
FIG. 5A is a rear view illustrating a computer generated desired three-dimensional body shape for the buttocks, in accordance with an aspect of the disclosure.

The routine or method 1600 begins at operation 1602, where a desired 3-D body shape or feature of the body is identified. The feature may be any body part or area of the body that is covered by the garment. For example, the feature may be the buttocks or the chest. In some embodiments, the desired 3-D body shape is generated by one or more computing devices. In some embodiments, the desired 3-D body shape is an attractive body shape based on known attractive size and shape ranges. In other embodiments, the desired 3-D body shape accentuates or minimizes the appearance of a specific feature of the body. For example, the desired body shape may be any desired range of sizes and/or shapes for one or more features. FIG. 5A illustrates an example of a computer generated desired 3-D body shape 550 for the buttocks 560.

Figure 5B:
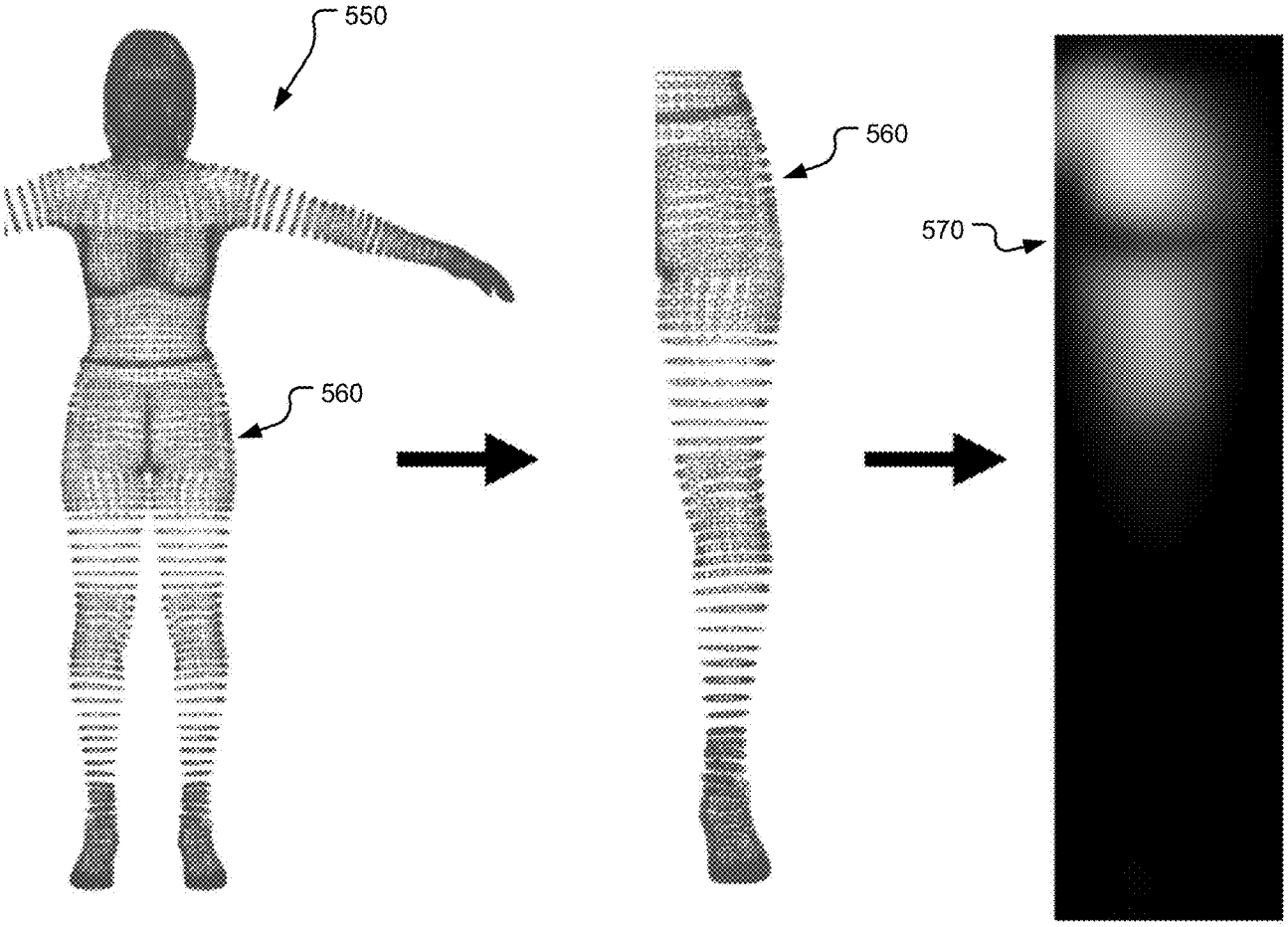
FIG. 5B is a schematic flow diagram illustrating a computer-generated conversion of the desired three-dimensional body shape of the buttocks shown in FIG. 5A to a two-dimensional depth map, in accordance with an aspect of the disclosure.

After the 3-D body shape is identified during operation 1602, method 1600 moves to operation 1604. At operation 1604, the desired 3-D body shape is converted into a 2-D depth map. In some embodiments, the 2-D depth map of the desired 3-D body shape is generated by one or more computing devices. For example, FIG. 5B illustrates an example of a computer-generated conversion of the desired 3-D body shape 550 of the buttocks 560 to a 2-D depth map 570.

Figure 5C:
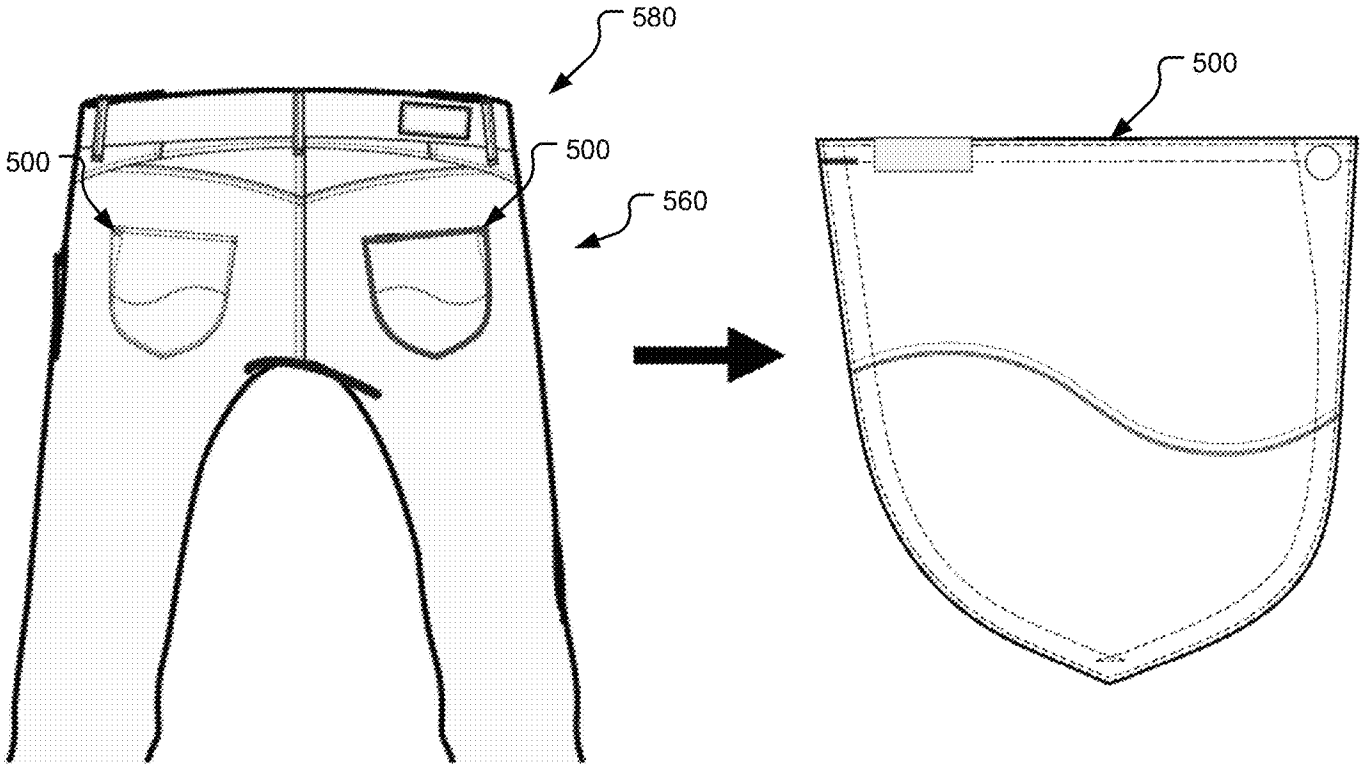
FIG. 5C is a schematic flow diagram illustrating a flat pair of jeans with conventional pockets that fall over the buttocks (identified as the desired feature in FIGS. 5A and 5B) that are identified for alteration or adjustment based on the pockets falling over the buttocks, in accordance with an aspect of the disclosure.

Next, method 1600 moves to operation 1606 where one or more construction lines and/or details for a flat garment are identified. In some embodiments, operation 1606 identifies preexisting construction lines and/or construction details on a flat garment for warping. In other embodiments, operation 1606 identifies construction lines and/or construction details to add to a flat garment to lie over or near one or more identified features. In further embodiments, operation 1606 identifies construction lines and/or construction details to add to a garment and identifies pre-existing construction lines and/or details on the flat garment. For example, FIG. 5C illustrates an example of a flat pair jeans 580 with conventional pockets 500 that fall over the buttocks 560 that are identified for alteration or adjustment based on their falling over the buttocks 560 (the identified desired feature of FIGS. 5A and 5B).

Figure 5D:
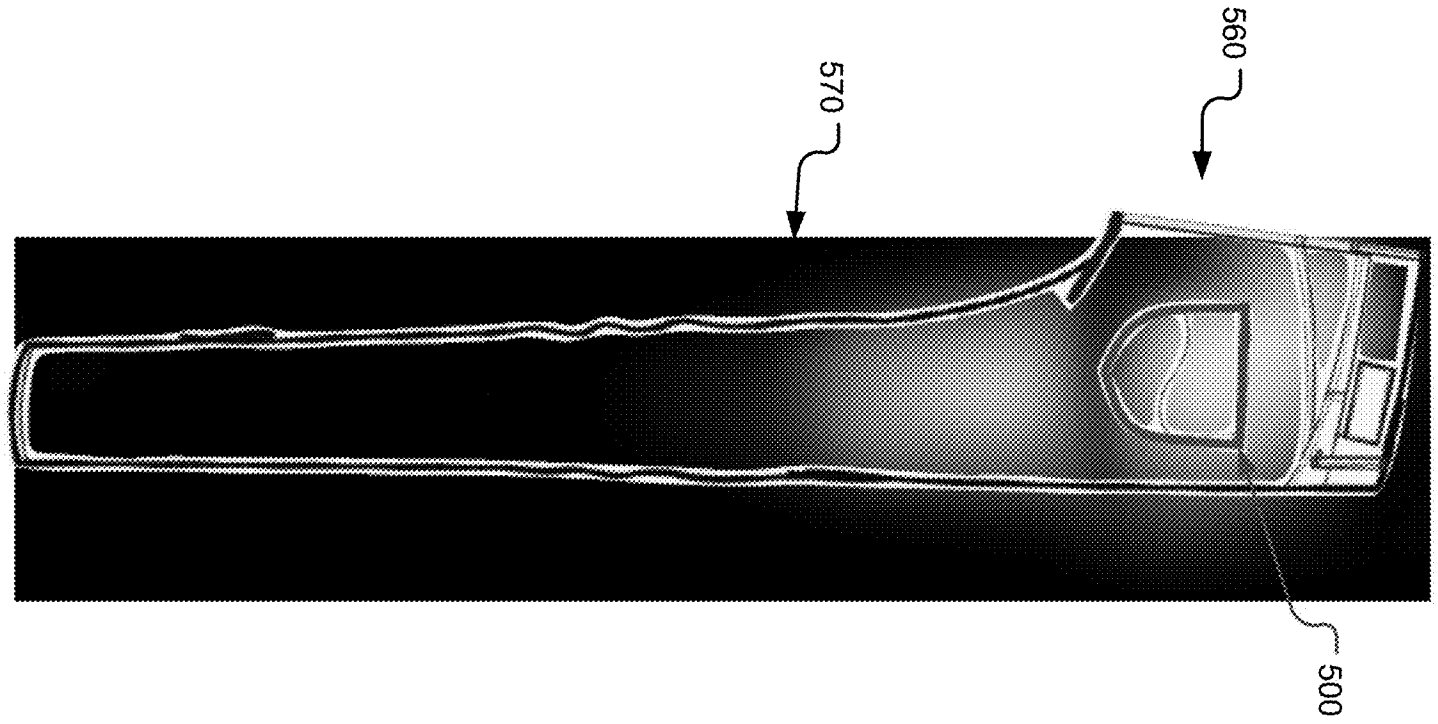
FIG. 5D is a partial rear view illustrating the conventional pocket as shown in FIG. 5C positioned over the buttocks on the two-dimensional depth map as shown in FIG. 5B, in accordance with an aspect of the disclosure.

Once the construction lines and/or details have been identified at operation 1606, operation 1608 is performed. At operation 1608, the construction lines and/or detail are positioned on the 2-D depth map of the desired 3-D body shape. In some embodiments, the size of the construction lines and/or details is also determined at operation 1608. The positioning at operation 1608 ensures that the one or more construction lines and/or details fall over or near the selected feature appropriately when worn. In some embodiments, operation 1608 is performed by one or more computing devices. For example, FIG. 5D illustrates an example of the flat pockets 500 as shown in FIG. 5C being positioned over the buttocks 560 on the 2-D depth map 570. In some embodiments, the positioning and/or the size of the construction lines and/or details are determined at operation 1608 by utilizing an adaptive genetic algorithm, which will be described in more detail below. In other embodiments, the positioning and/or the size of the construction lines and/or details are determined at operation 1608 based on the rules of perception and/or visual inspection. In further embodiments, the size and positioning may come from an adjustment task where the consumer can adjust the size and position of the construction lines and/or details on a simulated garment. For example, the consumer may move a slider left or right, where left simulates smaller size and right simulates larger size. Consumer preferences are accumulated to inform the preferred sizing and positioning and are then applied to the construction details.

Next, operation 1610 is performed. At operation 1610, the construction lines and/or details are adjusted based on their position on the 2-D depth map to create warped construction details and/or lines. In other words, the construction lines and/or details are displaced according to the 2-D depth map at operation 1610 to show the curves that would be created on the flat pocket if it were being worn by a body with the desired feature. In some embodiments, operation 1610 is performed by one or more computing devices.

Figure 5E:
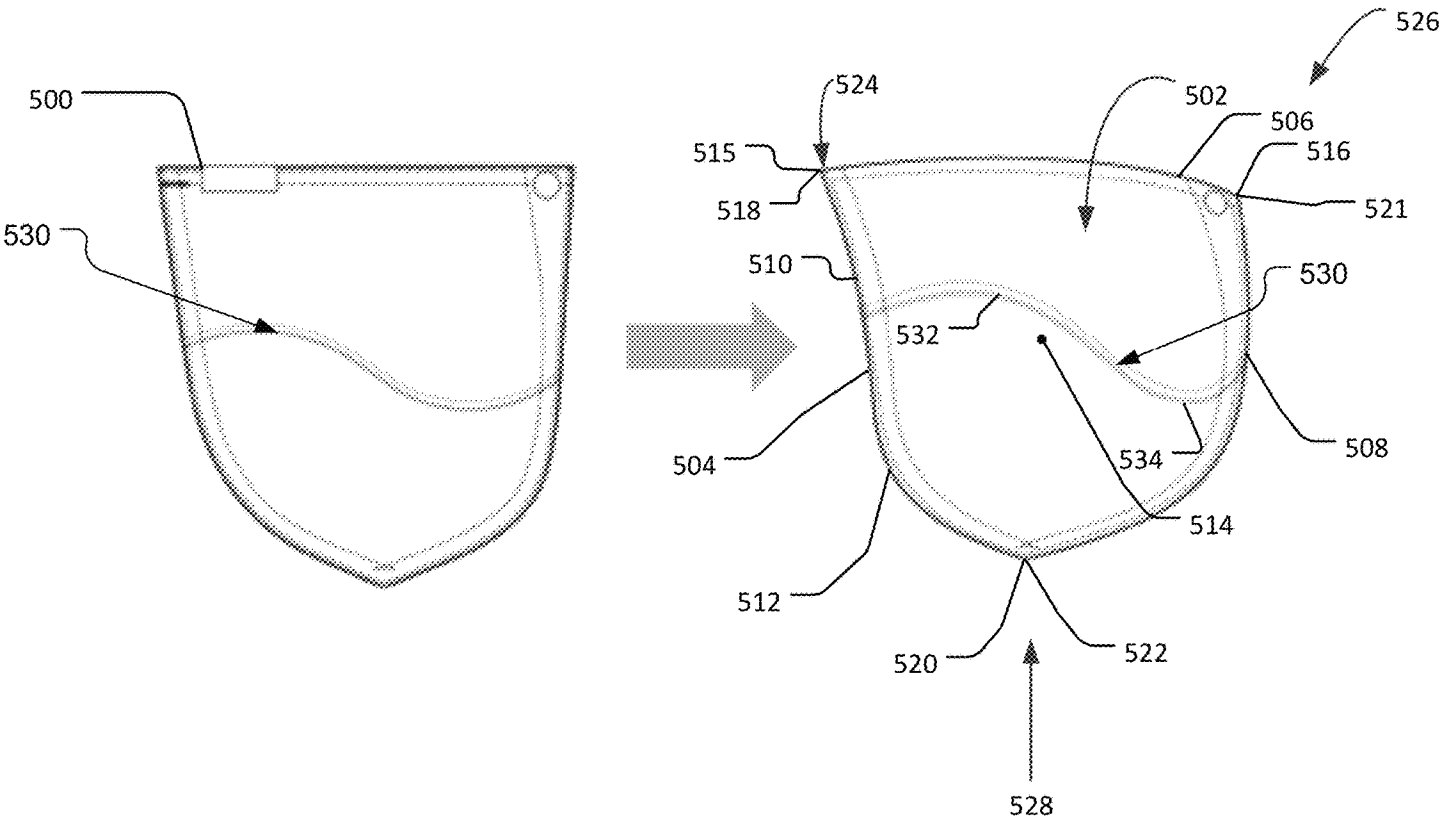
FIG. 5E is a front planar view illustrating the 2-D image of the selected flat pocket (or conventional pocket 500) shown in FIG. 5E and the 2-D image of the anatomy warped pocket created utilizing perspective projection from the 2-D depth map shown in FIG. 5D, in accordance with an aspect of the disclosure.

After operation 1610, operation 1612 is performed. At operation 1612, a 2-D image of the warped construction lines and/or details is created utilizing perspective projection. In some embodiments, operation 1612 is performed by one or more computing devices. The formed 2-D image provides a template for adding anatomy warped construction lines and/or details to a garment that changes the perception of the identified feature towards the appearance of the desired 3-D body shape. For example, FIG. 5E illustrates an example of the 2-D image of the selected flat pocket 500 (or conventional pocket 500) and the 2-D image of the anatomy-warped pocket 502 created utilizing perspective projection from the 2-D depth map 570.

In some embodiments, a consumer may further adjust an anatomy warped construction line and/or detail formed during operation 1612. This input may come from an adjustment task where the consumer can adjust the amount of warping on a simulated garment. For example, the consumer may move a slider left or right, where left simulates less warping and right simulates more warping. Consumer preferences are then accumulated to inform the preferred amount of warping to apply to the construction lines and/or details during operation 1612.

At operation 1614, the warped construction lines and/or details based on the 2-D image are utilized to construct a garment and/or added to an already constructed garment. In some embodiments, the one or more determined construction lines and/or construction details are formed on a garment with a machine and/or in an automated assembly process. In other embodiments, the one or more determined construction lines and/or construction details are manually added to or constructed on the garment. In alternative embodiments, the one or more determined construction lines and/or construction details are formed manually and via a machine.

Figure 17:
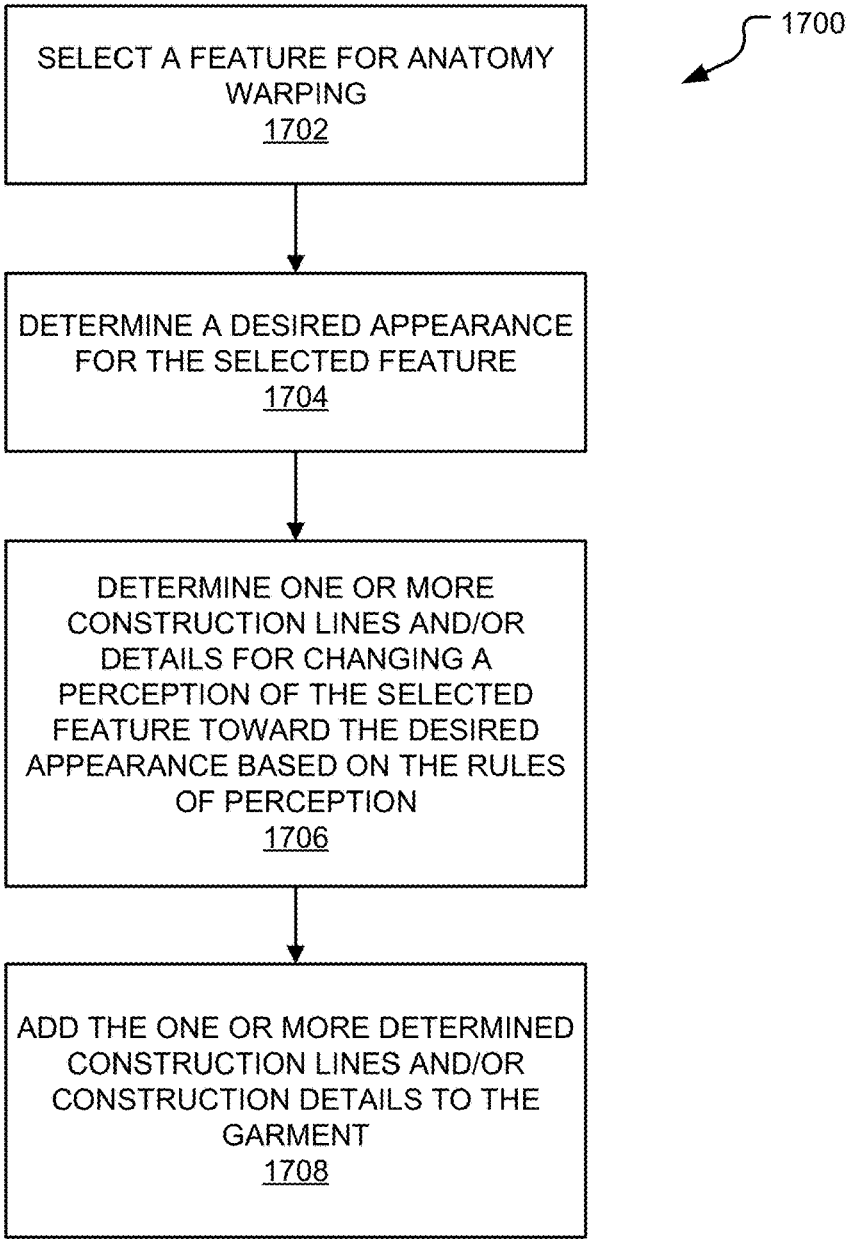
FIG. 17 is a flow diagram illustrating a method for designing or constructing an anatomy-warped garment, in accordance with an aspect of the disclosure.

In some embodiments, a method 1700 for designing an anatomy-warped garment is disclosed as illustrated in FIG. 17. The method 1700 includes: selecting a feature for anatomy warping at operation 1702; determining a desired appearance for the selected feature at operation 1704; determining one or more construction lines and/or details for changing a perception of the selected feature toward the desired appearance based on the rules of perception at operation 1706; and adding the one or more determined construction lines and/or construction details to the garment at operation 1708. Operation 1706 may include determining the positioning of the lines and/or details on the garment and/or determining the sizing of the lines and/or details on the garment.

In some embodiments, the amount of warping, sizing, and/or positioning of the construction lines and/or details is determined or adjusted based on consumer feedback during the determining the one or more construction lines and/or details. For example, the amount of warping, positioning, and/or sizing of the constructions lines and/or details may be determined by utilizing an adjustment task where consumers may adjust the amount of warping on a simulated garment. For example, the consumer may move a slider left or right, where left simulates less warping (increased sizing and/or location shifting) and right simulates more warping (decreased sizing and/or location shifting). Consumer preferences are then accumulated to inform the preferred amount of warping (sizing and/or location) to apply to the construction lines and/or details.

In alternative embodiments, a method for designing or constructing an anatomy-warped garment is provided. The method includes: identifying a desired 3-D body shape; converting the 3-D body shape into a 2-D depth map; identifying construction details and/or lines for a flat garment; positioning the construction details and/or lines on the 2-D depth map of the garment; adjusting the construction details and/or lines utilizing the position on the 2-D depth map to create warped construction details and/or lines; and creating a 2-D image of the warped construction details and/or lines using perspective projection; and constructing a garment with the warped construction details and/or lines based on the 2-D image of the warped construction details and/or lines.

Figure 18:
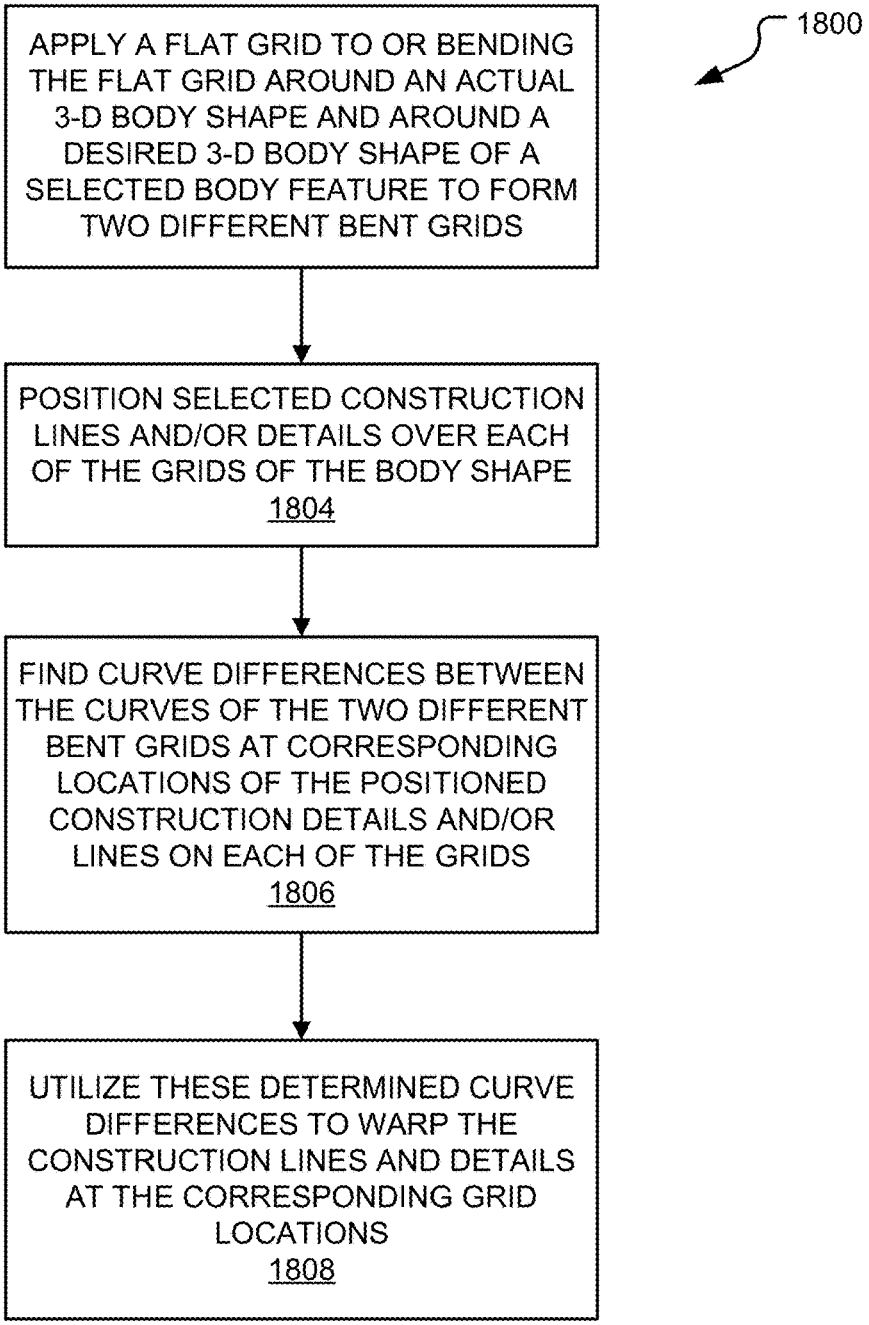
FIG. 18 is a flow diagram illustrating a method for designing or constructing an anatomy-warped garment, in accordance with an aspect of the disclosure.

In further embodiments, a method 1800 for designing or constructing an anatomy-warped garment is provided as illustrated in FIG. 18. The method 1800 includes: applying a flat grid to or bending the flat grid around an actual 3-D body shape and around a desired 3-D body shape of a selected body feature to form two different bent grids at operation 1802; positioning selected construction lines and/or details over each of the grids of the body shape at operation 1804; finding curve differences between the curves of the two different bent grids at corresponding locations of the positioned construction details and/or lines on each of the grids at operation 1806; and utilizing these determined curve differences to warp the construction lines and details at the corresponding grid locations at operation 1808.

As discussed above, FIG. 5E is a front planar view illustrating a conventional pocket 500 and an anatomy-warped pocket 502, in accordance with an aspect of the disclosure. Based on process 1600, the conventional pocket 500 was adjusted to include an S-shaped curve on the interior edge 504 as shown in the anatomy-warped pocket 502. In this embodiment, pocket 502 includes an interior edge 504 with a first curve 510 above a second curve 512. The first curve 510 of the interior edge 504 arches toward the center 514 of the pocket 502 and the second curve of the interior edge 504 arches away from the center 514 of the pocket 502.

Additionally, in this embodiment, the top edge 506 of pocket 502 is curved to change the appearance of the buttocks of the wearer. Stated another way, pocket 502 includes a curved top edge 506 that arches away from the center 514 of pocket 502. In this embodiment, based on process 1600 the exterior edge 508 of pocket 502 was also curved to change the appearance of the buttocks of the wearer. As such, the pocket 502 includes a curved exterior edge 508 that arches away from the center 514 of the pocket 502. Additionally, the pocket 502 is asymmetric with the exterior edge 508 being shorter and/or rounder than the interior edge 504 to change the perception of the buttocks of the wearer. In other words, the curved exterior edge 508 is longer than the interior edge 504 of pocket 502. The curved top edge 506 of the pocket 502 includes an interior end 515 and an exterior end 516. The interior edge 504 of the pocket 502 includes an upper end 518 and a lower end 520. The upper end 518 and the interior end 515 meet to form an upper interior corner 524 on the pocket 502. The exterior edge 508 of the pocket 502 includes a top end 521 and a bottom end 522. The exterior end 516 meets with the top end 521 to form an upper exterior corner 526. The lower end 520 and the bottom end 522 meet to form a lower corner 528.

Further, based on process 1600, accent detail 530 of the conventional pocket 500 was also adjusted. The interior curve 532 was widened and increased in height, while the width of the exterior curve 534 was made smaller but also increased in depth based on process 1600 to change the perception of the buttocks of the wearer.

In addition to determining ideal construction lines for the pocket 502, ideal construction details for the pocket were also determined, such as size and placement by process 1600. In this embodiment, the method 1600 decreased the pocket size and moved the position of the pocket upwards and inwards when compared to the conventional pocket size and placement to change the perception of the buttocks.

As discussed above, in some embodiments, an adaptive genetic algorithm may be utilized to determine size and/or placement of construction line and/or detail. The adaptive genetic algorithm utilizes data from various test subjects to find the most desired size and position for a construction line and/or detail on a garment for a specific feature of the wearer. In this process, subjects are given a random set of different garments illustrating a specific feature (i.e., buttocks, chest, legs, waist, etc.) of the wearer with various different construction lines and details that change the appearance of these features of the wearer. The subjects are then asked to select a garment or garments from the group that is most attractive or best demonstrates the desired feature. The algorithm then selects different new garments based on the previous selections containing different construction lines and details to change the appearance of the wearer and asks the same subjects to again select the garment or garments from the group that is most attractive or best demonstrates the desired feature. Each construction line and/or detail is specifically created to alter the appearance of wearer based on the rules of perception. This process is performed repeatedly. In some embodiments, the algorithm converges on the most attractive or most desired size and/or position of the construction lines and/or details for a garment located over or near a particular feature after about 20 generations or trials. However, any suitable system or method may be utilized to position and/or size the construction lines and/or details based on the rules of perception for anatomy warping.

In some embodiments, the distance between the upper interior corner 518 of anatomy-warped pockets 502 is from 2 inches to 3 inches, from 1.75 inches to 3 inches, from 2 inches to 2.75 inches, or from 2.25 inches to 2.5 inches. In further embodiments, the distance between the exterior end 516 to the yoke is from 1 inch to 1.5 inches. In other embodiments, the height of each pocket 502 is from 4 inches to 5.5 inches, from 4 inches to 5 inches, from 4.25 inches to 4.75 inches or from 4 inches to 9 inches at the center 514 of each of the pocket 502. In additional embodiments, the width of each pocket 502 is from 4.5 to 5.5 inches or from 4.5 to 7 inches at the top edge 506. In further embodiments, the width of the pocket 502 at the center 514 is about 0.25 inches, 0.5 inches, or 0.75 inches smaller than the width at the top edge 506 of the pocket 502. In other embodiments, the distance between the interior end 515 to the yoke is from 0.5 inches to 0.75 inches. In further aspects, Table 1 below lists different size and placement dimensions for warped pockets located over the buttocks of a wearer on a rear side of different pant styles utilizing anatomy warping.

Surprisingly, the placement, size, and shape of the pockets found to increase attractiveness of the wearer applied across a variety pant sizes and styles with only small differences as illustrated by Table 1 below. Additionally, the placement, size, and shape of the pockets found to increase attractiveness of a buttocks of wearer applied across different ethnicities and geographic regions with only small differences, such as China and India.

Figure 11:
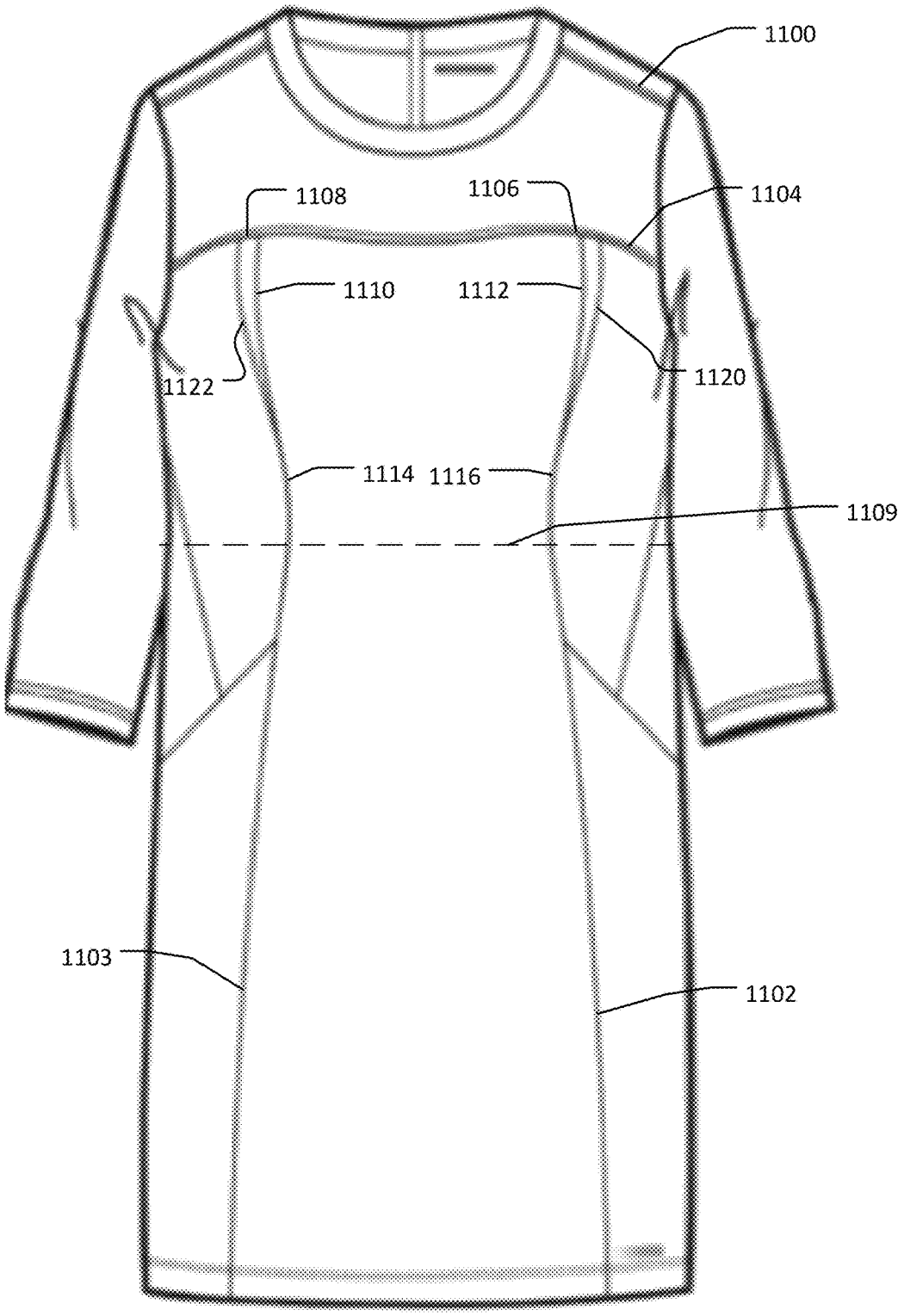
FIG. 11 is a front planar view illustrating a dress lying flat with anatomy-warped seams, in accordance with an aspect of the disclosure.
Figure 12:
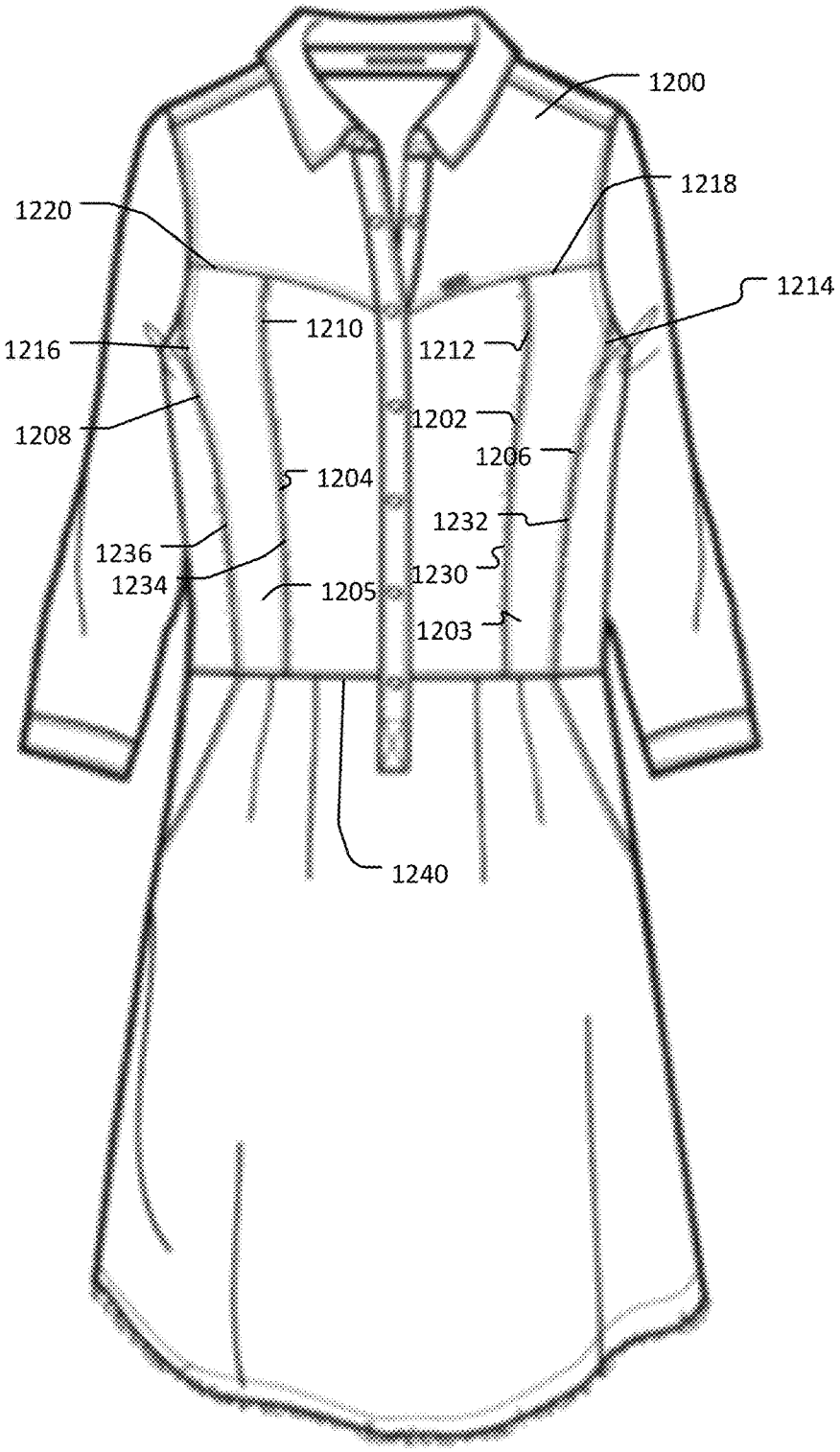
FIG. 12 is a front planar view illustrating a dress lying flat with anatomy-warped seams, in accordance with an aspect of the disclosure.

In addition to pockets, other constructions lines often appear on the rear side of a garment, such as a yoke. As illustrated in FIG. 3, a yoke 310 is a seam line on the rear side of jeans 300 above the buttocks or on the upper portion of the buttocks and below a waistline 312 of jeans 300. The waistline as utilized herein refers to a horizontal line that extends around the garment at a location at or near the waist of a wearer when worn. In some embodiments, the waistline is a seam or line visible on the garment. In other embodiments, the waistline is an invisible line that can be drawn on the garment at or near the waist of the wearer when worn. In alternative embodiments, the waistline is at least partially visible and at least partially invisible on the garment. For example, FIG. 11 illustrates an invisible waistline 1109 and FIG. 12 illustrates a visible waistline 1240. If pockets are present, the yoke 310 is located above the pockets 306 and below the waistline 312 of the garment. Conventionally, the yoke 310 is a straight light that either goes straight and horizontally across the back of a garment as illustrated in FIG. 3 or is two straight lines that angle slightly downwards and meet at the center 314 of the rear side of the garment creating a wide V-shape. Similar to the straight edges 308 of the pockets 306, when the wearer 304 wears the straight yoke 310 on jeans 300, the yoke 310 appears to curve. The brain interprets this curve and estimates a size and shape of the buttocks based on this curve.

Figure 6:
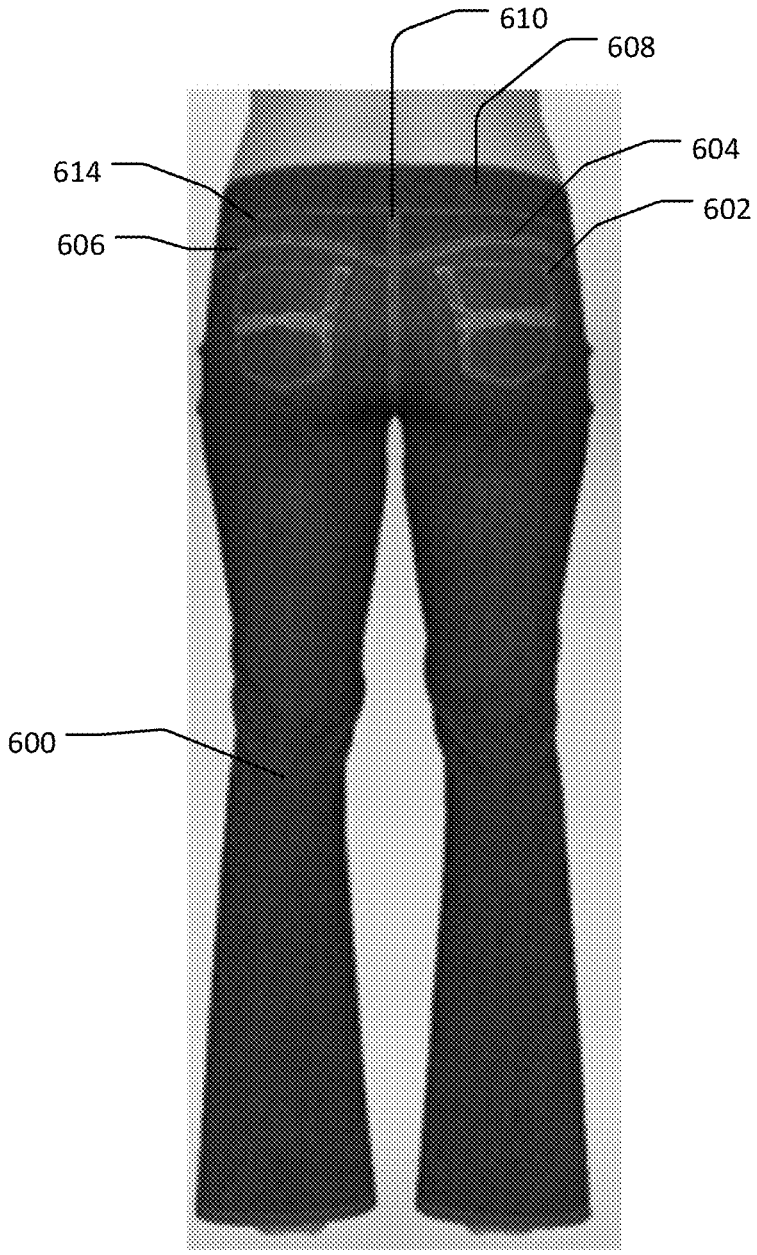
FIG. 6 is a rear view of a garment illustrating an anatomy-warped yolk, in accordance with an aspect of the disclosure.

Accordingly, in some embodiments, the shape, size, and/or positioning of the yoke is anatomy warped to change the perceived shape of the buttocks. In some embodiments, each side of a yoke is curved on a garment to change the perception of the buttocks and make wearer's buttocks appear rounder and/or perkier as illustrated in FIG. 6. FIG. 6 is a rear view of a garment 600 illustrating an anatomy-warped yolk 602 to change the perception of the buttocks of the wearer, in accordance with an aspect of the disclosure. The yoke 602 has a right curve 604 and a left curve 606. In this embodiment, the right curve 604 and the left curve 606 each arc or arch towards the waistline 608 of the garment 600. The right curve 604 and the left curve 606 each extend from a different side seam and connect at the horizontal center 610 of the rear side of the garment 600 to create a shape similar to the top of a heart or similar to a sweetheart neckline. In this embodiment, the yoke 602 changes the perception of the buttocks of the wearer to appear rounder and/or perkier when compared to the same garment with a conventional yoke on the same wearer.

In some embodiments, the left curve 606 and the right curve 604 are closest to the waistline 608 of the garment at a distance from 2.5 inches to 4.25 inches, from 3.75 inches to 3.5 inches, from 3 inches to 3.5 inches, from 3 inches to 3.75 inches, from 0 inches to 8 inches, or from 3.25 inches to 4 inches from the horizontal center 610 of the rear side. In further embodiments, each of the left curve 606 and the right curve 604 are from 0.5 inches to 1.5 inches below a lower waist seam 614 of the waistline 608 at the distance from 3 inches to 3.5 inches from the horizontal center 610 of the rear side. In additional embodiments, each of the left curve 606 and the right curve 604 are at a distance from 1.5 inches to 2.25 inches or from 1⅞ inches to 1.75 inches from a lower waist seam 614 at a first side seam. In other embodiments, each of the left curve 606 and the right curve 604 are at a distance from 0.5 inches to 1.5 inches or from 0 inches to 5 inches to the lower waist seam 614 at the distance from 3 inches to 3.5 inches or a distance from 2.5 to 8 inches from the horizontal center 610 of the rear side. In other aspects, Table 1 below list different sizes and placement dimensions for a yoke located over or just above the buttocks of a wearer on a rear side of different pant styles utilizing anatomy warping.

Figure 7:
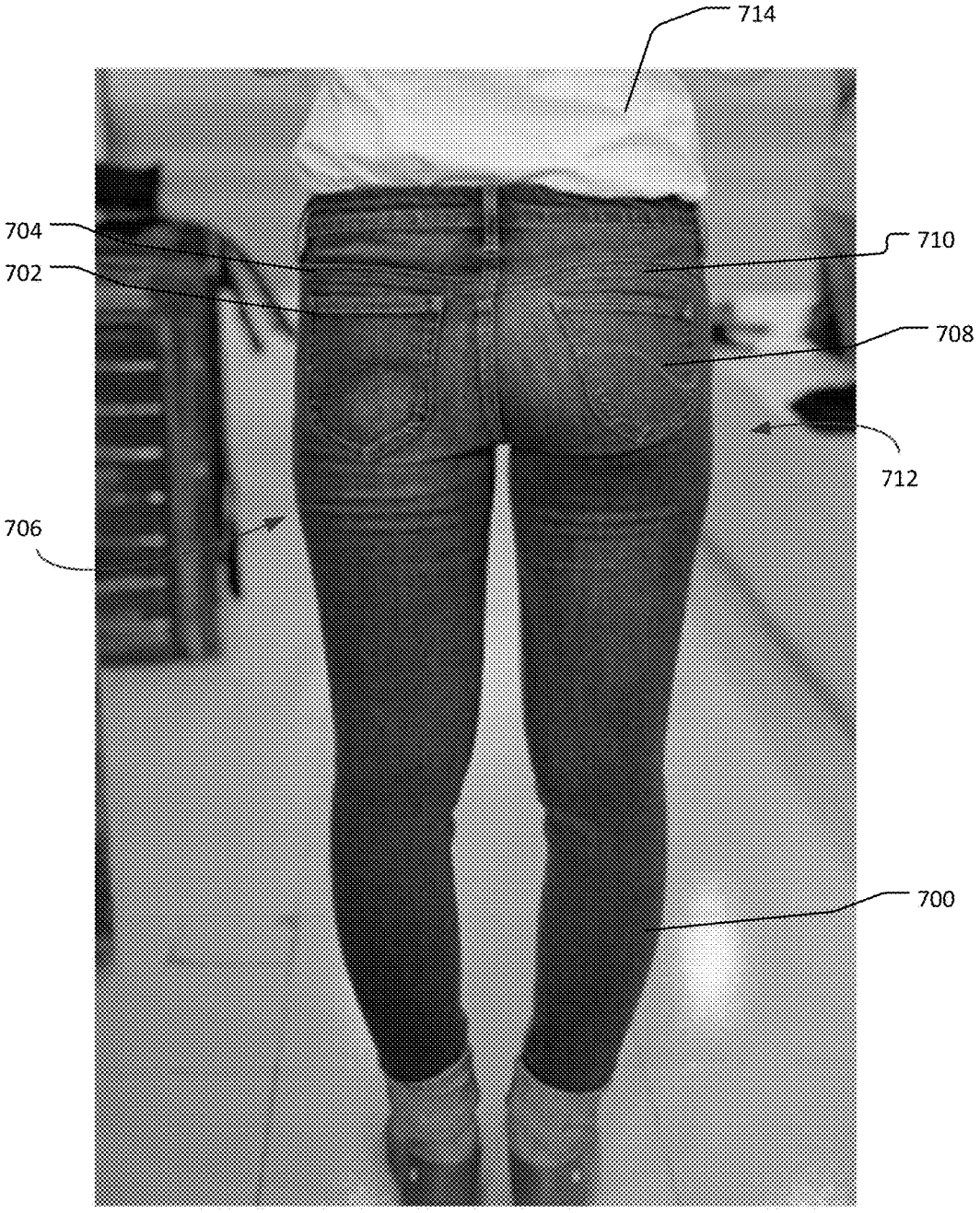
FIG. 7 is a rear view illustrating a pair of jeans with a conventional pocket and a conventional yoke on first portion of a garment and an anatomy-warped pocket and an anatomy-warped yoke on a second portion of the garment on a wearer, in accordance with an aspect of the disclosure

FIG. 7 is a rear view illustrating a pair of jeans 700 with a conventional pocket 702 and a conventional yoke 704 on a first side 706 and an anatomy-warped pocket 708 and an anatomy-warped yoke 710 on a second side 712 of a wearer 714, in accordance with an aspect of the disclosure. FIG. 7 illustrates how subtle modifications to the curve of the pocket 708 and the yoke 710 utilizing the rules of perception can cause the brain to perceive the same buttocks in a very different way. For example, the first side 706 with the conventional pocket 702 and yoke 704 makes the buttocks appear flat, while the second side 712 with the anatomy-warped pocket 708 and anatomy-warped yoke 710 make the buttocks appear round and/or perky, even though, the same person 714 is wearing both sides 706 and 712 of the jeans 700. As such, the anatomy-warped pocket 708 and/or the anatomy-warped yoke 710 change the appearance of the buttocks of the wearer to appear rounder and/or perkier when compared to conventional pocket 702 and/or a conventional yoke 704. In some embodiments, the anatomy-warped pocket 708 and/or the anatomy-warped yoke 710 change the appearance of the buttocks of the wearer to appear more attractive when compared to conventional pocket 702 and/or a conventional yoke 704.

Figure 14:
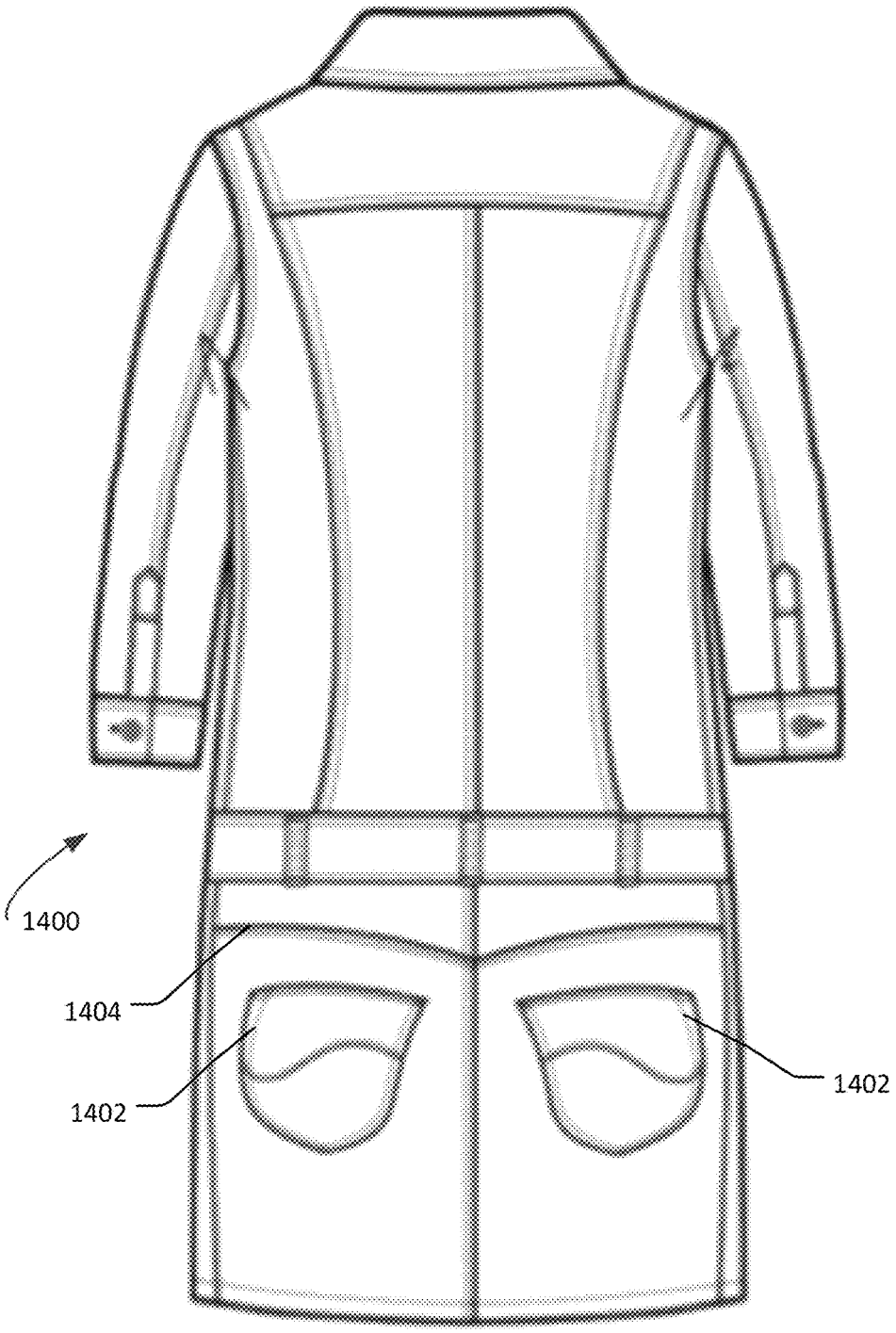
FIG. 14 is a rear planar view illustrating a dress lying flat with anatomy-warped pockets and an anatomy-warped yoke, in accordance with an aspect of the disclosure.

While the anatomy warped pockets and yoke discussed above have been illustrated on pants, these anatomy warped construction lines and details can be applied to the rear side of various different garments, such as skirts, shorts, capris, overalls, skorts, and dresses. For example, FIG. 14 is a rear planar view illustrating a dress with anatomy-warped pockets 1402 and an anatomy-warped yoke 1404, in accordance with an aspect of the disclosure. While the anatomy warped pockets and yoke discussed above have focused on a desired roundness range for increased attractiveness, any desired feature ranges/dimensions may be utilized by anatomy warping to change the perception of the buttocks toward desired feature ranges/dimensions utilizing the rules of perception. For example, the rules of perception may be utilized to change the perception of the buttocks to move toward or fall within a desired size range, a flatness range, and/or another shape range for the buttocks.

Figure 8:
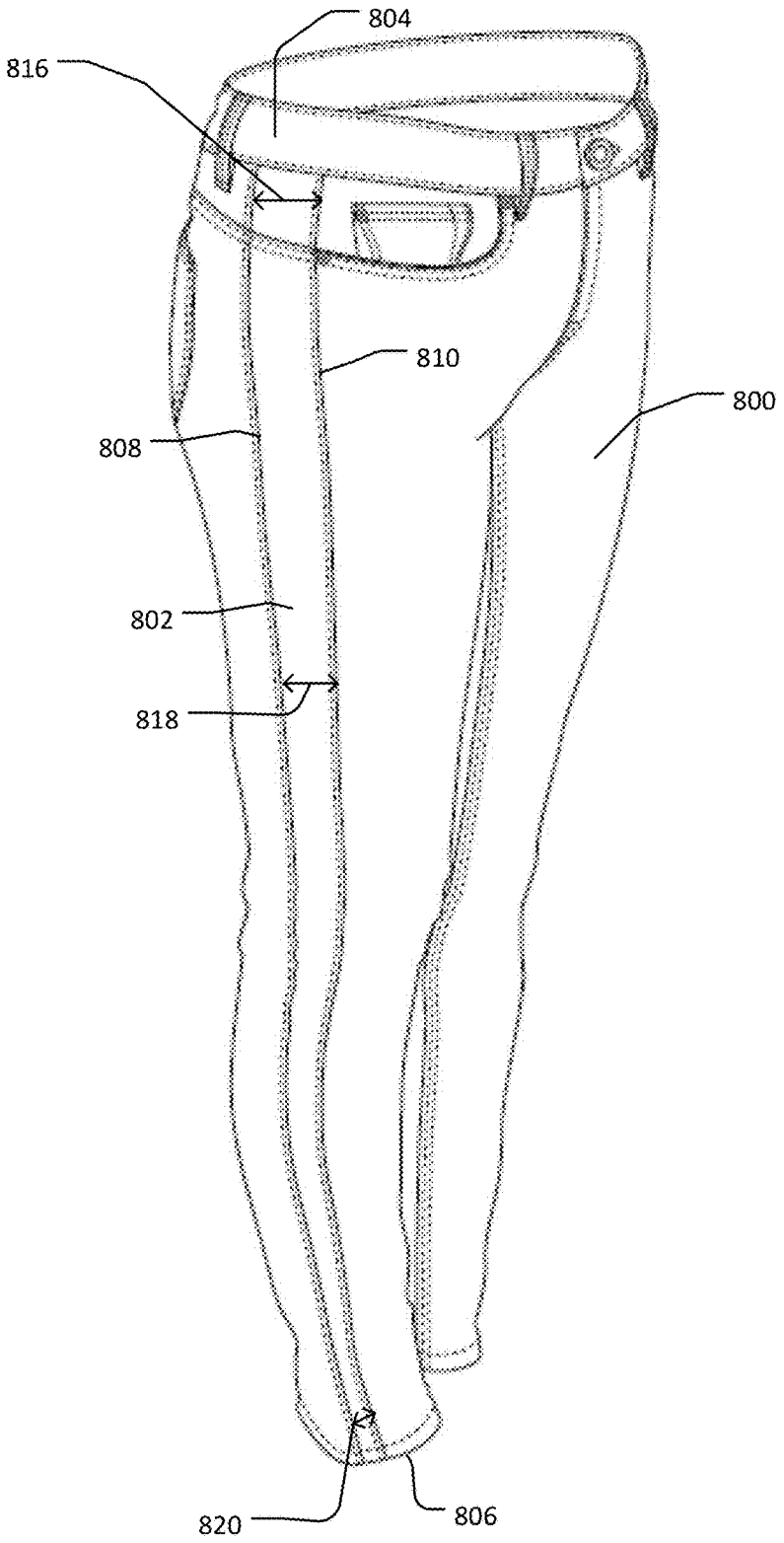
FIG. 8 is a front left perspective view illustrating a pair of jeans with side panels, in accordance with an aspect of the disclosure.

In addition to modifying or adjusting construction lines and/or details already present on a garment, additional construction lines or construction details may be added to a garment for anatomy warping. For example, a side panel 802 on each side of a pair of pants 800 that gradually decreases in width from the waistline 804 to the bottom 806 and may makes the legs of the wearer appear longer and/or slimmer as illustrated in FIG. 8. FIG. 8 is a left perspective view illustrating a pair of pants 800 that includes a side panel 802, in accordance with an aspect of the disclosure. In some aspects, a side panel 802 may be utilized to anatomy-warp the legs of wearer. In this embodiment, a first side panel 802 may be formed between a first seam 808 and a second seam 810. A second side panel opposite the first side panel may be formed between a third seam and fourth seam. In this embodiment, the width of the first side panel 802 and second side panel gradually decreases from the waistline 804 to the bottom 806 of pants 800. For example, the width near the waistline 816 is larger than the width near a vertical center 818 of the pants 800. Further, the width near the waistline 816 and the width near the vertical center 818 of the pants are both larger and/or wider than the width near the bottom 820 of pants 800. In some embodiments, the first side panel and second side panel may utilize anatomy warping to make the legs of the wearer look longer, shorter, thinner, larger and/or any other desired feature dimensions for the legs of a wearer of the garment.

In some embodiments, the width of the first side panel and second side panel is from 1 inch to 2 inches at the waistline 816 of the pants and from ⅛ inches to ⅞ inches at the bottom 820 of the pants 800. In other embodiments, the width of the first side panel and second side panel is from 1 inch to 5 inches at the waistline 816 of the pants and from ⅛ inches to 3⅞ inches at the bottom 820 of the pants 800. In some embodiment, each side panel is located on the side between the rear side and the front side of the pants. In other embodiments, the side panel is located at least partially on the front side or the rear side of the pants. In alternative embodiments, each side panel is located entirely on the front side or rear side of the pants. In other embodiments, each side panel is located partially on the front side and partially on the rear side of the pants. When the side panels are located on the rear side or the front side of the pants, each side panel is located near or at the most exterior edge of the rear side or front side.

Figure 9:
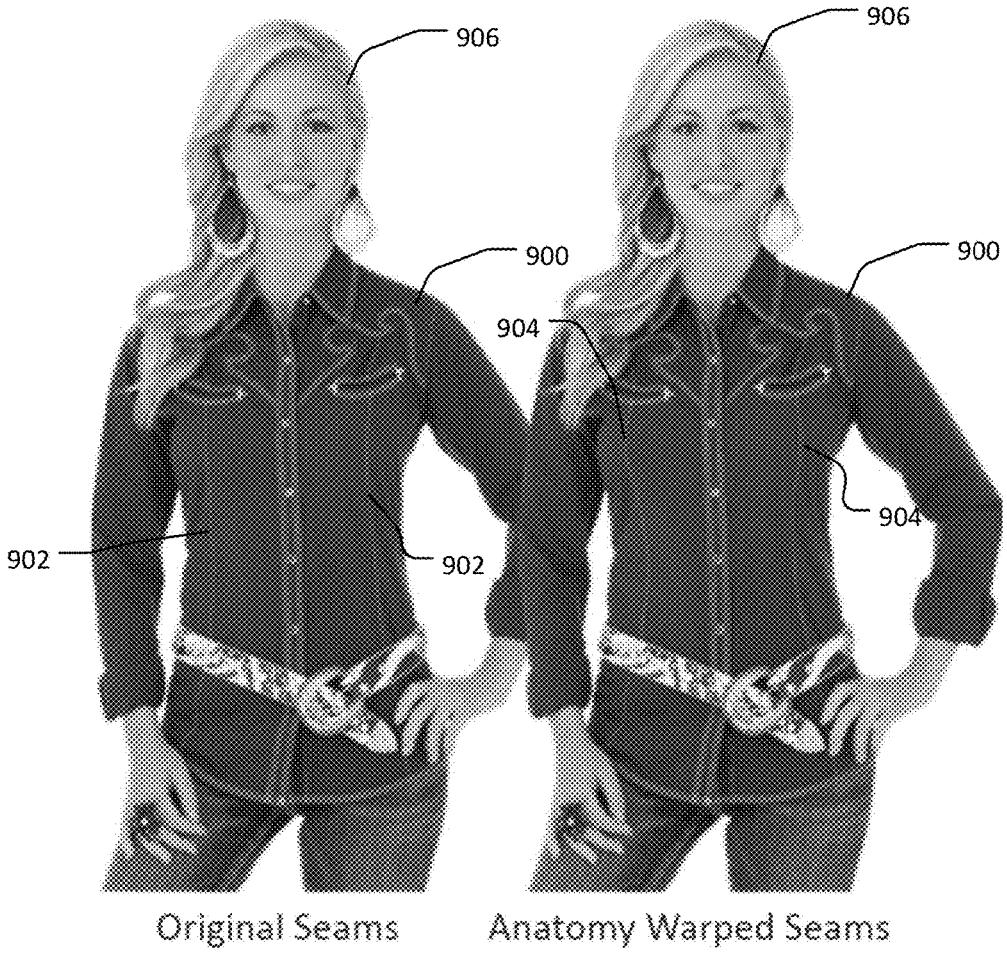
FIG. 9 is a front planar view illustrating a shirt with straight seams and the same shirt with anatomy-warped seams on the same person, in accordance with an aspect of the disclosure.

While the above construction lines and construction details focus on the legs and buttocks of the wearer, anatomy warping can also be applied to change the perception of other features of a wearer, such as the chest, torso, and/or waist. For example, FIG. 9 illustrates a shirt 900 with straight seams 902 and the same shirt 900 with anatomy-warped seams 904 on the same person 906, in accordance with an aspect of the disclosure. In this embodiment, the seams 924 on shirt 900 have been anatomy warped to increase the roundness and/or size appearance of the chest or bosom of the wearer 906. Accordingly, the anatomy-warped seams 904 curve outward or arch away from the horizontal center of the shirt 900 over the chest of the wearer 906. Additionally, in this embodiment, the seams 904 are straight above and below the chest of the wearer 906 on the garment. Therefore, the seams 904 are curved or adjusted over or near the feature being warped, such as the bosom in this embodiment.

Figure 10:
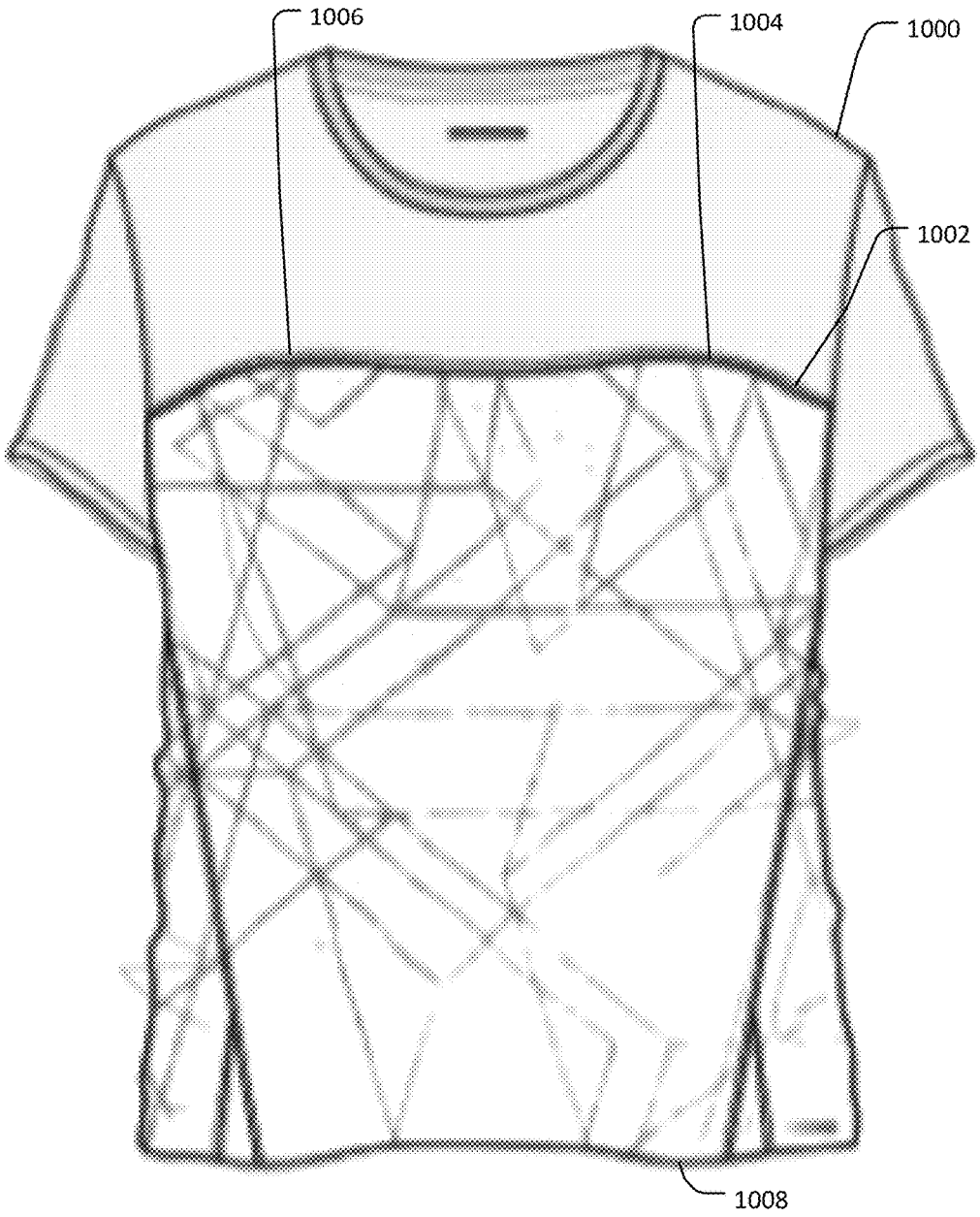
FIG. 10 is a front planar view illustrating a shirt lying flat with an anatomy-warped seam, in accordance with an aspect of the disclosure.

FIGS. 10-14 are front views of various different garments illustrating different anatomy warping techniques to change the perception of one or more features of the wearer. FIG. 10 is a front planar view illustrating a shirt with an anatomy-warped seam to change the appearance of a chest of wearer when worn, in accordance with an aspect of the disclosure. In this embodiment, a horizontal seam 1002 is located on garment 1000 over and/or near the upper portion of a chest of the wearer when worn. The anatomy-warped seam 1002 includes a first curve 1004 and second curve 1006 that arch away from the bottom 1008 of garment 1000. In this embodiment, each curve 1004, 1006 is position to fall over or near the bosom of the wearer when worn. Accordingly, in some embodiments, the anatomy warped horizontal seam 1002 makes the bosom appear rounder and/or larger when compared to a shirt that utilizes a straight horizontal seam on a garment when worn. In further embodiments, the anatomy warped horizontal seam 1002 makes the bosom appear more attractive, when compared to a shirt that utilizes a straight horizontal seam on a garment when worn. In some embodiments, the chest and/or waist is adjusted based on known attractive properties as determined and/or gathered by plastic surgeons.

FIG. 11 is a front planar view illustrating the dress 1100 with anatomy-warped seams 1102, 1103, 1104, 1122, and 1120 in accordance with an aspect of the disclosure. Similarly to FIG. 10, dress 1100 includes a horizontal anatomy-warped seam 1104 located on the dress 1100 over and/or near the upper portion of a chest of the wearer when worn. The anatomy-warped seam 1104 includes a first curve 1106 and second curve 1108 that arch away from the waistline 1109 of the wearer when worn. In this embodiment, each curve 1106, 1008 is positioned on the dress 1100 at or near the bosom of the wearer when worn. Similar to FIG. 9, the dress 1100 also includes anatomy-warped vertical seams 1102 and 1103 to change the appearance of a chest of wearer when worn. The anatomy-warped vertical seams 1102 and 1103 begin at the horizontal seam 1104 and curve outward 1110, 1112 or arch away from the horizontal center of the dress 1100 over and/or near the chest of the wearer. However, unlike the seams 904 in FIG. 9, in this embodiment, the seams 1102 and 1103 continue to curve inward 1114, 1116 below the chest of the wearer 906 on the garment. The curves 1114 and 1116 arch toward the vertical center of the dress 1100. The curves 1114 and 1116 not only make the bosom appear rounder and/or larger, but may also make the waist of the wearer appear smaller.

Additionally, vertical seams 1102 and 1103 each include a corresponding partial vertical seam 1122 and 1120. These corresponding seams 1122 and 1120 start from horizontal seam 1104 and extend downward and curve across the bosom of the wearer. Further, the width between seams 1122 and 1103 and between 1102 and 1120 gradually decreases from horizontal seam 1104 until these seams meet as illustrate in FIG. 11. Similar to the side panels 802 on pants 800 as discussed above, these anatomy-warped vertical seams 1120 and 1122 not only make the bosom appear rounder and/or wider, but may also make the bosom of the wearer to appear vertically longer to the human brain due to the change in width.

FIG. 12 is a front planar view illustrating a dress 1200 with anatomy-warped seams 1202, 1204, 1206, 1208, 1218, and 1220, in accordance with an aspect of the disclosure. In this embodiment, dress 1200 utilizes four separate vertical anatomy-warped seams 1202, 1204, 1206, 1208 to change the appearance of the chest or bosom of the wearer. Additionally, the four separate vertical anatomy-warped seams 1202, 1204, 1206, 1208 may decrease the size of the waist and may make the torso of the wearer appear longer. In this embodiment, the seams 1202 and 1206 form a first front seam panel 1203 and seams 1204 and 1208 form a second front seam panel 1205. Accordingly, the anatomy-warped seams 1202, 1204, 1206, 1208 or first front seam panel 1203 and second front seam panel 1205 each include a curve 1210, 1212, 1214, and 1216 that arches away from the horizontal center of the dress 1200 over the chest of the wearer. Further, in this embodiment, the width of the first front seam panel 1203 and the second front seam panel 1205 gradually decreases from the top of each seam panel to the bottom of each seam panel. As such, the torso of the wearer may appear longer, and/or slimmer. The four separate vertical anatomy-warped seams 1202, 1204, 1206, 1208 each include an upper end and lower end. The upper ends are located closer to the exterior of the front side than the lower ends. Accordingly, the first front seam panel 1203 and the second front seam panel 1205 include a slight second lower curve 1230, 1232, 1334, and 1236 that arches toward the horizontal center of the dress. As such, the waist of the wearer may appear smaller. Further, dress 1200 includes a left horizontal curve 1220 and a right horizontal curve 1218 across or near the bust line of the wearer that arch toward the top of the dress 1200 and angles downward. As such, the bosom of the wearer of dress 1200 may appear rounder and/or larger when compared to dresses that utilized straight horizontal lines across or near the chest of the wearer. FIG. 12 illustrates how different anatomy warped construction lines and details can be used in combination and across different features.

Figure 13:
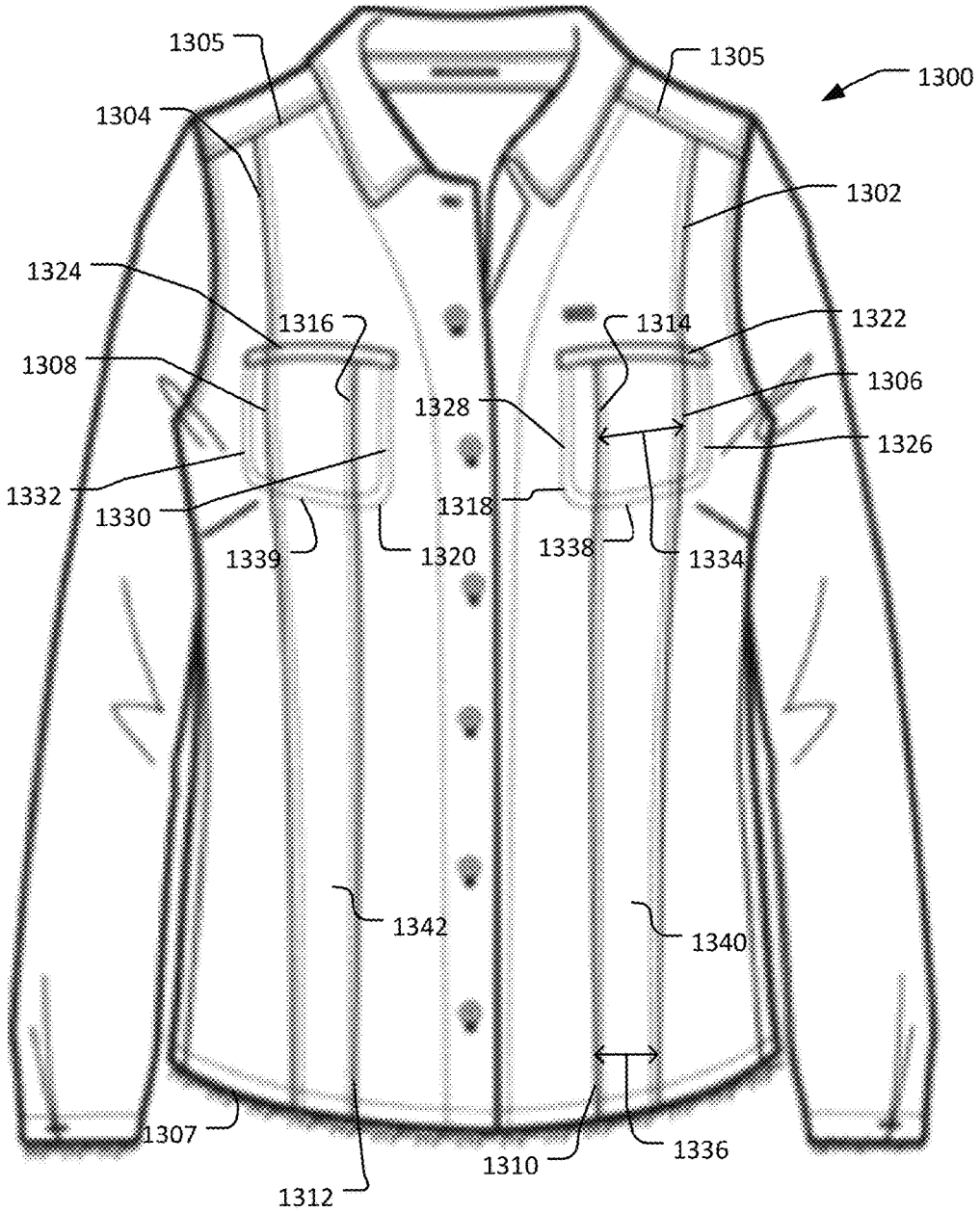
FIG. 13 is a front planar view illustrating a shirt lying flat with anatomy-warped seams and pockets, in accordance with an aspect of the disclosure.

FIG. 13 is a front planar view illustrating a shirt 1300 with anatomy-warped seams 1302, 1304, 1310, 1312 and pockets 1318, 1320 in accordance with an aspect of the disclosure. FIG. 13 illustrates another example of how different anatomy-warped construction lines and details can be used in combination across the same and different features. For example, vertical seams 1302, 1304, 1310, 1312 and pockets 1318, 1320 all make the bosom of the wearer appear rounder and/or larger. Further, vertical seams 1302, 1304, 1310, and 1312 may also make the torso and/or bosom of the wearer appear longer. Vertical seams 1302 and 1304 extend down from a top or a top seam 1305 of shirt 1300 to the bottom 1307 of shirt 1300. Each seam 1302 and 1304 curve 1308 and 1306 over and/or near the bosom of the wearer when worn. The curves 1308 and 1306 arch toward the exterior of the shirt 1300. Each seam 1302 and 1304 includes corresponding interior vertical seams 1310 and 1312 to form a left vertical panel 1342 and a right vertical panel 1340. The interior vertical seams 1310 and 1312 extend from a top edge 1322 and 1324 of pockets 1320 and 1318 to the bottom 1307 of shirt 1300. Additionally, the interior vertical seams 1310 and 1312 also curve 1314 and 1316 across and/or near the bosom of the wearer when worn. The panels 1340 and 1342 gradually decrease in width from the top edges 1322 and 1324 of pockets 1318 and 1320 to the bottom 1307 of shirt 1300. For example, the width 1334 near the top of panel 1340 is greater than the width 1336 of panel 1340 near the bottom 1307. The curves 1306, 1308, 1314, and 1316 of seams 1302, 1304, 1310, and 1312 make the bosom of the wearer appear larger and/or rounder. Further, the gradual decrease in width of the vertical panels 1340 and 1342 form by seams 1302, 1304, 1310, and 1312 may make the torso of the wearer appear longer and/or slimmer.

Shirt 1300 as illustrated in FIG. 13 also includes a left pocket 1320 and a right pocket 1318 located over and/or near the bosom of the wearer when worn. Each of the pockets 1318 and 1320 includes a top edge 1322, 1324, an interior edge 1328, 1330, an exterior edge 1326, 1332, and a bottom edge 1338, 1339. As illustrated by FIG. 13, the top edges 1322 and 1324 of pockets 1318 and 1320 are curved such that they arch toward the top 1305 of shirt 1300. The curved top edges 1322 and 1324 make the bosom appear rounder and/or larger than a straight top edge would. Further, both pockets 1318 and 1320 include interior edges 1328 and 1330 that are longer than their corresponding exterior edges 1326 and 1332. Accordingly, pockets 1318 and 1320 gradually decrease in vertical height from the interior edges 1328 and 1330 to the exterior edge 1326 and 1332. This gradual decrease in height of pockets 1318 and 1320 may make the bosom of the wearer appear wider and therefore, larger when compare to pockets that have uniform height.

The anatomy-warped construction lines and details on a garment as discussed above utilize the rules of perception to change the appearance of a feature of the wearer. While the above examples adjust curves, angles, widths, and/or heights of construction lines and construction details or add construction lines and/or construction details to change the perception of body features, these adjustments must be subtle enough that the brain interprets the warped lines and/or details as being created by the shape of the wearer instead of attributing them to the garment itself. For example, changes to construction lines and construction details that are too large or too extreme are interpreted by the brain and attributed to the garment itself instead of the wearer. These type of changes are design choices and may fall outside the definition of anatomy warping.

While anatomy warping has been described in detail for specific features of female garments, the principles discussed above for anatomy warping can be applied to various other female garments and various other male garments. Additionally, while the disclosed anatomy-warped construction details and lines were discussed on specific garments and in specific combinations above, any of the disclosed anatomy-warped construction details and/or lines may be utilized alone and/or in any combination on any desired garment. Further, as understood by a person of skill in the art additional anatomy warping of construction lines and/or details other than discussed above may be utilized to change the appearance of a feature discussed above. Additionally, as understood by a person of skill in the art, additional anatomy warping of construction lines and/or details may be utilized to change the appearance of the additional features that have not been discussed above. Additionally, while the disclosed anatomy-warped construction details and lines were discussed above with regards to specific desired feature ranges and dimension, the rules of perception may be utilized to change the appearance of a garment toward any desired feature ranges or dimensions.

EXAMPLES

Figure 15:
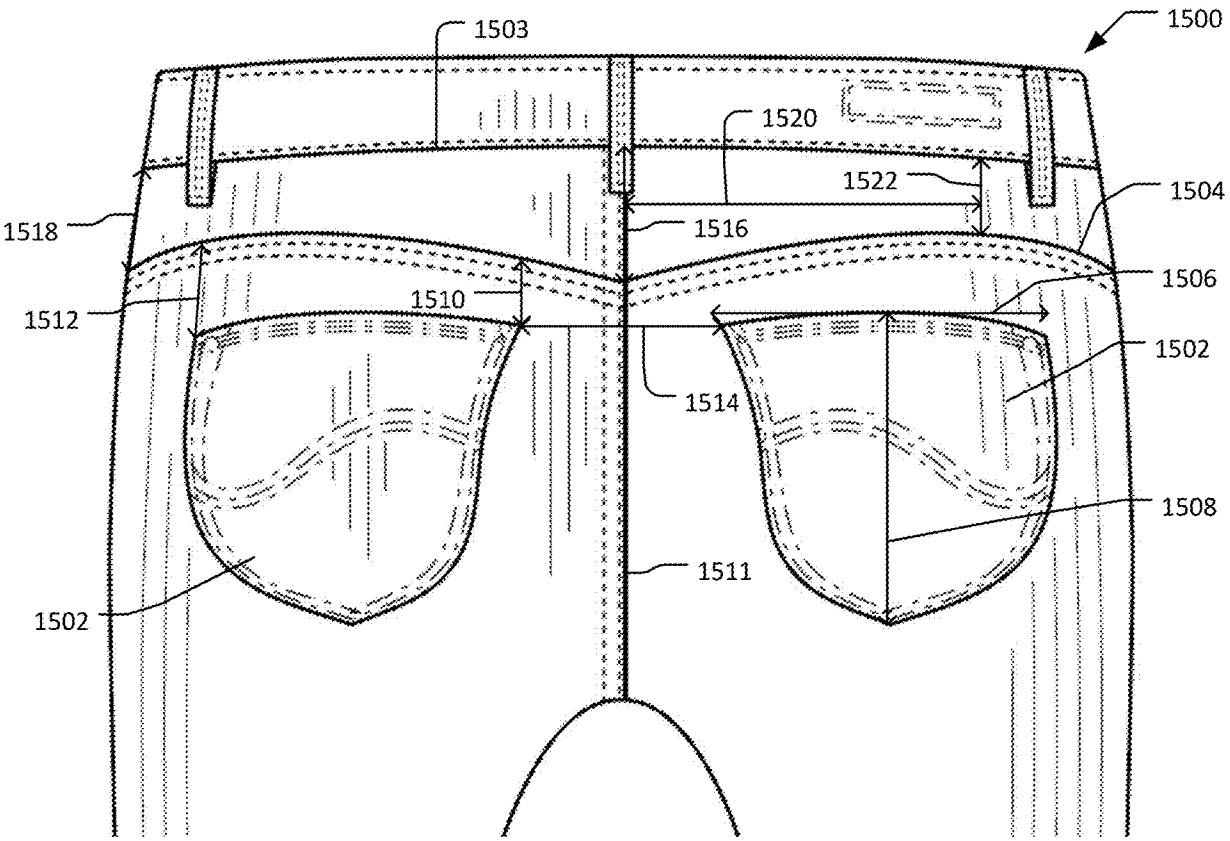
FIG. 15 is a partial rear view of a pair of pants lying flat that illustrates the different measurement locations described in Table 1, in accordance with an aspect of the disclosure.

Table 1 below lists different placement and measurements for anatomy-warped pockets and yokes on the rear side of different jean styles. These measurement and placements are exemplary only and are not meant to be limiting. As known by a person of skill in the art other placements and sizes of the yoke and rear pockets may be utilized for anatomy warping of the buttocks. FIG. 15 is a partial rear view of a pair of pants 1500 that illustrates the different measurement locations described in Table 1, in accordance with an aspect of the disclosure. FIG. 15 illustrates two different back pockets (BPs) 1502 and a back yoke (BY) 1504. The width at the opening of the back pocket 1502 is shown by width 1506. The height of the back pocket 1502 at the middle of the pocket 1502 is demonstrated by height 1508. The distance of the back pocket 1502 from the back yoke 1504 is shown by height 1510 toward the center of the pants and height 1512 toward the side of the pants. Further, the back pockets 1502 are located at a specific distance from interior corner to interior corner from each other as illustrated by width 1514.

The measurements and placement of the back yoke 1504 as measured in Table 1 below are also illustrated by FIG. 15. The height of the back yoke 1504 from the lower waist seam 1503 at the center back (CB) 1511 of the pants 1500 is shown by height 1516 and from the side seam by height 1518. The distance from the center back 1511 of the pants 1500 to the narrowest part between the yoke 1504 and the lower waist seam 1503 is shown by width 1520. The distance between the back yoke 1504 and the lower waist seam 1503 that is the smallest distance between the lower waist seam 1503 and the yoke 1504 is illustrated by height 1522 in FIG. 15.

TABLE 1

Pocket and Yoke Placement and Size Dimensions

| Pant Style | Measurement Location (inches) | Stand. Dev. | Size 23 | Size 24 | Size 25 | Size 26 | Size 27 | Size 28 | Size 29 | Size 30 |
|---|---|---|---|---|---|---|---|---|---|---|
| Ultra - Low Rise - Super Slim | BP* Width at opening | +/−⅛ | 4¾ | 4¾ | 4¾ | 5 | 5 | 5 | 5¼ | 5¼ |
| | BP Height at middle | +/−⅛ | 4½ | 4½ | 4½ | 4¾ | 4¾ | 4¾ | 5 | 5 |
| | BP Position from yoke - center × side | +/−⅛ | 1 × 1¼ | 1 × 1¼ | 1 × 1¼ | 1 × 1¼ | 1 × 1¼ | 1 × 1¼ | 1 × 1¼ | 1 × 1¼ |
| | BP Distance from interior corner to corner | +/−⅛ | 2¼ | 2¼ | 2¼ | 2½ | 2½ | 2½ | 2¾ | 2¾ |
| | BY** Height CB*** × side seam | +/−⅛ | 1⅞ × 1¾ | 1⅞ × 1¾ | 1⅞ × 1¾ | 1⅞ × 1¾ | 1⅞ × 1¾ | 1⅞ × 1¾ | 1⅞ × 1¾ | 1⅞ × 1¾ |
| | BY Narrowest Part Position from CB seam | +/−0 | 3 | 3 | 3¼ | 3¼ | 3½ | 3½ | 3¾ | 3¾ |
| | BY Height at narrowest | +/−0 | ⅞ | ⅞ | ⅞ | ⅞ | ⅞ | ⅞ | ⅞ | ⅞ |
| Low Rise - Super Slim | BP Width at opening | +/−⅛ | 4¾ | 4¾ | 4¾ | 5 | 5 | 5 | 5¼ | 5¼ |
| | BP Height at middle | +/−⅛ | 4½ | 4½ | 4½ | 4¾ | 4¾ | 4¾ | 5 | 5 |
| | BP Position from yoke - center × side | +/−⅛ | ⅞ × 1¼ | ⅞ × 1¼ | ⅞ × 1¼ | ⅞ × 1¼ | ⅞ × 1¼ | ⅞ × 1¼ | ⅞ × 1¼ | ⅞ × 1¼ |
| | BP Distance from interior corner to corner | +/−⅛ | 2¼ | 2¼ | 2¼ | 2½ | 2½ | 2½ | 2¾ | 2¾ |
| | BY Height CB × side seam | +/−⅛ | 1⅞ × 1¾ | 1⅞ × 1¾ | 1⅞ × 1¾ | 1⅞ × 1¾ | 1⅞ × 1¾ | 1⅞ × 1¾ | 1⅞ × 1¾ | 1⅞ × 1¾ |
| | BY Narrowest Part Position from CB seam | +/−0 | 3¼ | 3¼ | 3½ | 3½ | 3¾ | 3¾ | 4 | 4 |
| | BY Height at narrowest | +/−0 | 1 | 1 | 1 | 1 | 1 | 1 | 1 | 1 |
| Mid Rise - Super Skinny | BP Width at opening | +/−⅛ | 4¾ | 4¾ | 4¾ | 5 | 5 | 5 | 5¼ | 5¼ |
| | BP Height at middle | +/−⅛ | 4½ | 4½ | 4½ | 4¾ | 4¾ | 4¾ | 5 | 5 |
| | BP Position from yoke - center × side | +/−⅛ | ⅞ × 1¼ | ⅞ × 1¼ | ⅞ × 1¼ | ⅞ × 1¼ | ⅞ × 1¼ | ⅞ × 1¼ | ⅞ × 1¼ | ⅞ × 1¼ |
| | BP Distance from interior corner to corner | +/−⅛ | 2¼ | 2¼ | 2¼ | 2½ | 2½ | 2½ | 2¾ | 2¾ |
| | BY Height CB × side seam | +/−⅛ | 2 × 1¾ | 2 × 1¾ | 2 × 1¾ | 2 × 1¾ | 2 × 1¾ | 2 × 1¾ | 2 × 1¾ | 2 × 1¾ |
| | BY Narrowest Part Position | +/−0 | 2¾ | 2¾ | 3 | 3 | 3¼ | 3¼ | 3½ | 3½ |

TABLE 1-continued

| Pant Style | Measurement Location (inches) | Stand. Dev. | Size 23 | Size 24 | Size 25 | Size 26 | Size 27 | Size 28 | Size 29 | Size 30 |
|---|---|---|---|---|---|---|---|---|---|---|
| | Pocket and Yoke Placement and Size Dimensions | | | | | | | | | |
| | from CB seam | | | | | | | | | |
| | BY Height at narrowest | +/−0 | 1 | 1 | 1 | 1 | 1 | 1 | 1 | 1 |
| High Rise - Super Skinny | BP Width at opening | +/−⅛ | 4¾ | 4¾ | 4¾ | 5 | 5 | 5 | 5¼ | 5¼ |
| | BP Height at middle | +/−⅛ | 4½ | 4½ | 4½ | 4¾ | 4¾ | 4¾ | 5 | 5 |
| | BP Position from yoke - center × side | +/−⅛ | ⅝ × 1¼ | ⅝ × 1¼ | ⅝ × 1¼ | ⅝ × 1¼ | ⅝ × 1¼ | ⅝ × 1¼ | ⅝ × 1¼ | ⅝ × 1¼ |
| | BP Distance from interior corner to corner | +/−⅛ | 2¼ | 2¼ | 2¼ | 2½ | 2½ | 2½ | 2¾ | 2¾ |
| | BY Height CB × side seam | +/−⅛ | 2 × 2 | 2 × 2 | 2 × 2 | 2 × 2 | 2 × 2 | 2 × 2 | 2 × 2 | 2 × 2 |
| | BY Narrowest Part Position from CB seam | +/−0 | 2¾ | 2¾ | 3 | 3 | 3¼ | 3¼ | 3½ | 3½ |
| | BY Height at narrowest | +/−0 | 1 | 1 | 1 | 1 | 1 | 1 | 1 | 1 |
| High Rise Super Skinny | BP Width at opening | +/−⅛ | 4¾ | 4¾ | 4¾ | 5 | 5 | 5 | 5¼ | 5¼ |
| | BP Height at middle | +/−⅛ | 4½ | 4½ | 4½ | 4¾ | 4¾ | 4¾ | 5 | 5 |
| | BP Position from yoke - center × side | +/−⅛ | 1 × 1⅜ | 1 × 1⅜ | 1 × 1⅜ | 1 × 1⅜ | 1 × 1⅜ | 1 × 1⅜ | 1 × 1⅜ | 1 × 1⅜ |
| | BP Distance from interior corner to corner | +/−⅛ | 2¼ | 2¼ | 2¼ | 2½ | 2½ | 2½ | 2¾ | 2¾ |
| | BY Height CB × side seam | +/−⅛ | 2 × 1¾ | 2 × 1¾ | 2 × 1¾ | 2 × 1¾ | 2 × 1¾ | 2 × 1¾ | 2 × 1¾ | 2 × 1¾ |
| | BY Narrowest Part Position from CB seam | +/−0 | 2¾ | 2¾ | 3 | 3 | 3¼ | 3¼ | 3½ | 3½ |
| | BY Height at narrowest | +/−0 | 1 | 1 | 1 | 1 | 1 | 1 | 1 | 1 |

Key for Abbreviations: *Back Pocket; Back Yoke; and *Center Back;

Aspects of the present disclosure, for example, are described above with reference to block diagrams and/or operational illustrations of methods, systems, and computer program products according to aspects of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

This disclosure described some aspects of the present technology with reference to the accompanying drawings, in which only some of the possible aspects were described. Other aspects can, however, be embodied in many different forms and the specific aspects disclosed herein should not be construed as limited to the various aspects of the disclosure set forth herein. Rather, these exemplary aspects were provided so that this disclosure was thorough and complete and fully conveyed the scope of the other possible aspects to those skilled in the art. For example, the various aspects disclosed herein may be modified and/or combined without departing from the scope of this disclosure.

Although specific aspects were described herein, the scope of the technology is not limited to those specific aspects. One skilled in the art will recognize other aspects or improvements that are within the scope and spirit of the present technology. Therefore, the specific structure, acts, or media are disclosed only as illustrative aspects. The scope of the technology is defined by the following claims and any equivalents therein.

Various embodiments and/or examples are described above with reference to block diagrams and/or operational illustrations of methods, systems, and computer program products. The functions/acts noted in the blocks may occur out of the order as shown in any flow diagram. For example, two blocks shown in succession may in fact be executed substantially concurrently or the blocks may sometimes be executed in the reverse order, depending upon the functionality/acts involved.

The description and illustration of one or more aspects provided in this application are not intended to limit or restrict the scope of the disclosure as claimed in any way. The embodiments, examples, and details provided in this application are considered sufficient to convey possession and enable others to make and use the best mode of claimed disclosure. The claims should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claims.

What is claimed is:

1. A body-enhancing garment, the garment comprising:
- a front side;
- a rear side, the rear side opposite the front side;
- a first pocket, the first pocket on the rear side and is configured to be positioned at least partially over a first cheek of a buttocks of a wearer of the garment when worn;
- a second pocket, the second pocket on the rear side and is configured to be positioned at least partially over a second cheek of the buttocks of the wearer of the garment when worn;
- wherein the first pocket and the second pocket, when lying flat, each comprises:
  - an interior edge connected to a curved top edge at an upper interior corner;
  - an exterior edge connected to the curved top edge at an upper exterior corner;
  - the interior edge connected to the exterior edge a lower corner;
  - the interior edge with a first curve starting at the upper interior corner above a second curve and ending at the second curve, wherein the second curve ends at the lower corner, wherein the first curve above the second curve to create an S-shape, and the first curve arches toward a center of a pocket and the second curve arches away from the center of the pocket, and
  - a curved top edge that arches away from the center of the pocket.

2. The garment of claim 1, wherein the
- exterior edge arches away from the center of the pocket, and
- wherein the exterior edge is longer than the interior edge.

3. The garment of claim 1, wherein a shape of the first pocket and the second pocket are created utilizing a two-dimensional depth map of a selected dimensions configured for a buttocks shape.

4. The garment of claim 1, wherein
- an arch of the curved top edge begins at the upper interior corner and ends at the upper exterior corner.

5. The garment of claim 1, wherein the interior edge includes an upper end and a lower end,
- wherein the curved top edge includes an interior end and an exterior end,
- wherein the upper end and the interior end connect to form the upper interior corner,
- wherein a distance between the upper interior corner of the first pocket and the second pocket is from 2 inches to 3 inches.

6. The garment of claim 1, further comprising:
- a yoke on the rear side,
- wherein the yoke is positioned between a waistline and the first and second pockets,
- wherein the curved top edge includes an interior end and an exterior end,
- wherein a first distance between the interior end to the yoke is from ½ inches to ¾ inches, and
- wherein a second distance between the exterior end to the yoke is from 1 inch to 1.5 inches.

7. The garment of claim 1, wherein the first pocket and the second pocket have a height from 4 inches to 5½ inches at the center of each of the first pocket and the second pocket and a first width from 4½ to 5½ inches at a top edge and a second width at the center of each of the first pocket and the second pocket that is about ½ inch smaller than the second width.

8. The garment of claim 1, further comprising:
- a yoke on the rear side,
- wherein the yoke is positioned between a waistline and the first and second pockets,
- wherein the yoke has right curve and a left curve, and
- wherein the right curve and the left curve each arc towards the waistline and connect at a horizontal center of the rear side.

9. The garment of claim 8, wherein each of the left curve and the right curve are closest to the waistline of the wearer at a distance from 3 inches to 3.5 inches from the horizontal center of the rear side.

10. The garment of claim 9, wherein the left curve and the right curve are from ¼ inches to 1½ inches below a lower waist seam at the distance from 3 inches to 3.5 inches from the horizontal center of the rear side.

11. The garment of claim 10, further comprising:
- a first side seam;
- a second side seam opposite the first side seam;
- wherein the left curve of the yoke is at a first distance from 1⅞ inches to 1¾ inches from the lower waist seam at the first side seam, and
- wherein the right curve of the yoke is at a second distance from 1⅞ inches to 1¾ inches from the lower waist seam at the second side seam.

12. The garment of claim 1, wherein the garment includes a first side panel and a second side panel opposite the first side panel, wherein a width of the first side panel and the second side panel gradually decreases from a waistline to a bottom of the garment.

13. A body-enhancing pair of pants, the pair of pants when lying flat comprising:

a front side;

a rear side, the rear side opposite and attached to the front side;

a first pocket, the first pocket on the rear side;

a second pocket adjacent to the first pocket on the rear side;

a first interior edge of the first pocket with a first end, a second end, and a first curve above a second curve to create an S-shape, wherein the first curve starts at the first end of the first interior edge and arches toward a center of the first pocket and ends at the beginning of the second curve, wherein the second curve arches away from the center of the first pocket and ends at the second end; and a second interior edge of the second pocket with a third end, a fourth end, and a third curve above a fourth curve to create and S-shape, wherein the third curve starts at the third end and arches toward a center of the second pocket and ends at the beginning of the fourth curve, wherein the fourth curve arches away from the center of the second pocket.

14. The pair of pants of claim 13, further comprising:

a first curved exterior edge of the first pocket that arches away from the center of the first pocket; and the first curved exterior edge is longer than the first interior edge and meets the first interior edge.

15. The pair of pants of claim 14, a second curved exterior edge of the second pocket that arches away from the center of the second pocket; and the second curved exterior edge is longer than the second interior edge and meets the second interior edge.

16. The pair of pants of claim 13, further comprising:

a distance between a first upper interior corner of the first pocket and a second upper interior corner of the second pocket is from 2 inches to 3 inches.

17. Pants, the pants comprising:

a front side;

a rear side, the rear side opposite the front side;

a first pocket on the rear side;

a second pocket on the rear side;

the first pocket and the second pocket when lying flat each comprises:

three sides, wherein the three sides include a top edge, a curved exterior edge, and an interior edge;

the interior edge connects at a first corner with the top edge and connects at a second corner with the curved exterior edge;

the top edge includes a curve that arches away from a center of a pocket;

the curved exterior edge arches away from the center of the pocket and connects to the top edge at a third corner; and the curved exterior edge is longer than the interior edge wherein, the interior edge comprises: a first curve above a second curve to create an S-shape, wherein the first curve arches toward the center of the pocket and the second curve arches away from the center of the pocket.

18. The pants of claim 17, wherein the curve of the top edge begins at the first corner and ends at the third corner.

19. The pants of claim 17, further comprising:

a distance between the first corner of the first pocket and the first corner of the second pocket that is from 2 inches to 3 inches: and a height from 4 inches to 5½ inches at the center of each of the first pocket and the second pocket.

* * * * *